US007889045B2

(12) United States Patent
Tomonari et al.

(10) Patent No.: US 7,889,045 B2
(45) Date of Patent: Feb. 15, 2011

(54) BALUN TRANSFORMER USING A DRUM-SHAPED CORE

(75) Inventors: Toshio Tomonari, Tokyo (JP); Hiroshi Suzuki, Tokyo (JP); Toshihiro Kuroshima, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/831,939

(22) Filed: Jul. 7, 2010

(65) Prior Publication Data

US 2010/0271160 A1 Oct. 28, 2010

Related U.S. Application Data

(63) Continuation of application No. 12/368,795, filed on Feb. 10, 2009, now Pat. No. 7,791,444.

(30) Foreign Application Priority Data

Feb. 29, 2008 (JP) ..... 2008-049829
Oct. 30, 2008 (JP) ..... 2008-280454

(51) Int. Cl.
*H01F 5/00* (2006.01)

(52) U.S. Cl. ..... 336/200

(58) Field of Classification Search ..... 336/65, 336/83, 170, 173, 180–184, 192, 200, 232
See application file for complete search history.

(56) References Cited

U.S. PATENT DOCUMENTS 5,805,431 A * 9/1998 Joshi et al. ..... 361/836
6,373,366 B1 * 4/2002 Sato et al. ..... 336/192

* cited by examiner

*Primary Examiner*—Tuyen Nguyen
(74) *Attorney, Agent, or Firm*—Young Law Firm, P.C.

(57) ABSTRACT

A balun transformer includes: a drum-shaped core having a core unit and a pair of flanges arranged on both sides of the core unit; a plurality of terminal electrodes arranged on the flanges; a primary winding wound around the core unit, both ends of the primary winding being connected to the terminal electrodes; and a secondary winding wound around the core unit, both ends and a center tap of the secondary winding being connected to the terminal electrodes, wherein the secondary winding includes a first wire extending from one end to the center tap, and a second wire extending from the other end to the center tap, and the first wire and the second wire are wound around the core unit so as to extend along each other.

20 Claims, 17 Drawing Sheets

BALUN TRANSFORMER USING A DRUM-SHAPED CORE

CROSS REFERENCE TO RELATED APPLICATIONS

The present application is a Continuation of copending and commonly assigned U.S. patent application Ser. No. 12/368,795 filed Feb. 10, 2009, which is hereby incorporated by reference in its entirety.

TECHNICAL FIELD

The present invention relates to a balun transformer, and more particularly relates to a balun transformer using a drum-shaped core.

BACKGROUND OF THE INVENTION

Transmission lines connected to an antenna or the like are generally unbalanced transmission lines, while transmission lines connected to a high-frequency circuit, such as a semiconductor IC, are balanced transmission lines. Accordingly, when connecting the unbalanced transmission line and the balanced transmission line, a balun transformer that mutually converts an unbalanced signal and a balanced signal is inserted between these lines. In this case, the unbalanced signal means a single ended signal with a fixed electric potential (such as a ground electric potential) as a reference, and the balanced signal means a differential signal.

A balun transformer using a spectacle-shaped core as described in Japanese Patent Application Laid-open No. H11-135330, and a balun transformer using a toroidal core as described in Japanese Patent Application Laid-open No. H8-115820 are examples of general balun transformers. However, there is a problem in the balun transformer using the spectacle-shaped core or the toroidal core in that not only it has a comparatively large overall size, but also it poses difficulties in the automation of the winding operation of a winding and in surface mounting.

Meanwhile, a balun transformer using a drum-shaped core as described in Japanese Patent Application Laid-open No. 2005-39446 has advantages that downsizing is easy and is suitable for the automation of the winding operation of a wiring and for surface mounting.

In the balun transformer using a drum-shaped core, however, its characteristics are greatly changed depending on a winding method of a secondary winding, and thus it is difficult to obtain a good high-frequency characteristic. Particularly in the high frequency area, it is difficult to obtain a good amplitude balance (amplitude balance in the balanced signal) and phase balance (phase balance in the balanced signal).

SUMMARY OF THE INVENTION

It is therefore an object of the present invention to provide a balun transformer using a drum-shaped core, capable of obtaining a good high-frequency characteristic.

Another object of the present invention is to provide a balun transformer using a drum-shaped core, having a good amplitude balance and phase balance in high frequency areas.

As a result of extensive studies by the present inventors, it has been found that the cause for deterioration in the amplitude balance and the phase balance in the high frequency area of a balun transformer using a drum-shaped core is a disturbance in the symmetry of two wires configuring a secondary wiring. The present invention has been completed based on such technical findings.

That is, a balun transformer according to the present invention includes: a drum-shaped core having a core unit and a pair of flanges arranged on both sides of the core unit; a plurality of terminal electrodes arranged on the flanges; a primary winding wound around the core unit with both ends connected to the terminal electrodes; and a secondary winding wound around the core unit with both ends and a center tap connected to the terminal electrodes. The secondary winding includes a first wire extending from one end to the center tap, and a second wire extending from the other end to the center tap, and the first wire and the second wire are wound around the core unit so as to extend along each other.

According to the present invention, the first wire and the second wire configuring the secondary winding are wound such that the both wires extend along each other, and thus a remarkably high level of symmetry is secured between these two wires. As a result, particularly in high frequency areas, it is possible to achieve favorable values for an amplitude balance and a phase balance. In the present invention, the "primary winding" and "secondary winding" do not define an input side and an output side. That is, a side connected to the unbalanced transmission line is defined as the "primary winding" and a side connected to the balanced transmission line is defined as the "secondary winding", for the convenient sake, however, any one of the input side and the output side can be the "primary winding" and the "secondary winding".

A preferable method for winding the two wires around the core unit such that the both wires extend along each other is a so-called bifilar winding. The bifilar winding is often adopted as a winding method for a common mode filter or the like. However, in the common mode filter, the primary winding and secondary winding are simply wound by bifilar winding. In contrast thereto, the present invention focuses on the symmetry of the two wires configuring the secondary winding, and these two wires are wound in a state of extending along each other as in the bifilar winding. Thereby, the symmetry between the secondary windings, which has not been paid attention to in the technical field, can be improved significantly. Note that the "state of extending along each other" is not limited to a state that the two wires are wound in contact with each other, but also includes a state that the two wires are wound by providing a constant space in between.

In the present invention, it is preferable that one end of the primary winding is connected to the terminal electrode arranged on one flange, and the other end of the primary winding is connected to the terminal electrode arranged on the other flange. Accordingly, it is not necessary to wind, while crossing the primary winding, and thus it becomes possible to suppress the occurrence of short circuits, thereby enabling improvement on the reliability of the product.

In this case, it is preferable that, as viewed from one direction, first to third terminal electrodes are arranged in this order on the one flange, and as viewed from the one direction, fourth to sixth terminal electrodes are arranged in this order on the other flange, one end of the primary winding is connected to the first terminal electrode, the other end of the primary winding is connected to the fourth terminal electrode, one end of the secondary winding is connected to the third terminal electrode, and the other end of the secondary winding is connected to the sixth terminal electrode. It is also preferable that out of the center tap of the secondary winding, a part belonging to the first wire is connected to the fifth terminal electrode, and a part belonging to the second wire is connected to the second terminal electrode. Accordingly, with the axis of the core unit as the center, the unbalanced transmission line can be connected to the first and fourth terminal electrodes positioned on one side, and with the axis of the core unit as the center, the balanced transmission line can be connected to the third and sixth terminal electrodes positioned on the other side. Thus, it becomes unnecessary, for example, to detour a wiring pattern configuring the transmission line, thereby making it possible to achieve a highly linear and symmetrical transmission line.

Further, in this case, it is preferable that the primary winding include a third wire from the one end to a relay point and a fourth wire from the other end to the relay point, a seventh terminal electrode located between the first and second terminal electrodes is further arranged on the one flange, and an eighth terminal electrode located between the fourth and fifth terminal electrodes is further arranged on the other flange. It is also preferable that out of the relay point, a part belonging to the third wire is connected to the eighth terminal electrode, a part belonging to the fourth wire is connected to the seventh terminal electrode, and the third and fourth wires are wound around the core unit so as to extend along each other. This results in a configuration such that the primary winding and the secondary winding are adjoined at parts where the number of times of turns from the corresponding terminal electrodes is equal to each other, which enables the improvement of the magnetic coupling of the primary winding and the secondary winding.

In the present invention, it is also preferable that the first and second terminal electrodes are arranged on one flange, and the third and fourth terminal electrodes are arranged on the other flange; one end of the primary winding is connected to the first terminal electrode, and the other end of the primary winding is connected to the second terminal electrode; the one end of the secondary winding is connected to the third terminal electrode, and the other end of the secondary winding is connected to the fourth terminal electrode, and the center tap of the secondary winding is connected to the second terminal electrode. Accordingly, the number of terminal electrodes can be reduced. Further, the unbalanced transmission line can be connected to the first and second terminal electrodes arranged on one flange, and the balanced transmission line can be connected to the third and fourth terminal electrodes arranged on the other flange. Thus, it becomes unnecessary, for example, to detour a wiring pattern configuring the transmission line, thereby making it possible to achieve a highly linear and symmetrical transmission line.

In this case, it is preferable that the primary winding is wound on an outer circumferential side of the core unit, and the secondary winding is wound on an inner circumferential side of the core unit. Accordingly, no excessive stress is applied to an intersecting part of the primary winding, and the reliability of the product can be improved.

In the present invention, it is also preferable that, as viewed from one direction, first to third terminal electrodes are arranged in this order on the one flange, and as viewed from one direction, fourth to sixth terminal electrodes are arranged in this order on the other flange, the one end of the primary winding is connected to the first terminal electrode, the other end of the primary winding is connected to the sixth terminal electrode; the one end of the secondary winding is connected to the third terminal electrode, and the other end of the secondary winding is connected to the fourth terminal electrode, and out of the center tap of the secondary winding, a part belonging to the first wire is connected to the fifth terminal electrode, and a part belonging to the second wire is connected to the second terminal electrode. Accordingly, the directionality at the time of mounting is nullified, and thus it becomes unnecessary to control amounting direction, thereby decreasing mounting costs. Further, it is not necessary to intersect the first and second wires, and thus the production is simplified.

In the present invention, it is also preferable that as viewed from one direction, first to third terminal electrodes are arranged in this order on the one flange, as viewed from one direction, fourth to sixth terminal electrodes are arranged in this order on the other flange, the one end of the primary winding is connected to the first terminal electrode, the other end of the primary winding is connected to the fourth terminal electrode, the one end of the secondary winding is connected to the third terminal electrode, the other end of the secondary winding is connected to the fifth terminal electrode, and out of a center tap of the secondary winding, a part belonging to the first wire is connected to the sixth terminal electrode, and a part belonging to the second wire is connected to the second terminal electrode. Accordingly, it is not necessary to intersect the first and second wires, and thus the production is simplified. Further, because there is almost no difference in the length and winding conditions between the wire configuring the primary winding and the first and second wires configuring the secondary winding, these wires can be maintained at a uniform state.

In the present invention, it is also preferable that as viewed from one direction, first to third terminal electrodes are arranged in this order on the one flange, and as viewed from one direction, fourth to sixth terminal electrodes are arranged in this order on the other flange, the one end of the primary winding is connected to the second terminal electrode, the other end of the primary winding is connected to the fifth terminal electrode, the one end of the secondary winding is connected to the third terminal electrode, the other end of the secondary winding is connected to the fourth terminal electrode, and out of a center tap of the secondary winding, a part belonging to the first wire is connected to the sixth terminal electrode, and a part belonging to the second wire is connected to the first terminal electrode. Accordingly, the directionality at the time of mounting is nullified, and it is not necessary to control the mounting direction, thereby decreasing mounting costs. Further, it is not necessary to intersect the first and second wires, and thus the production is simplified.

In the present invention, it is also preferable that as viewed from one direction, first to third terminal electrodes are arranged in this order on the one flange, and as viewed from one direction, fourth to sixth terminal electrodes are arranged in this order on the other flange, the one end of the primary winding is connected to the second terminal electrode, the other end of the primary winding is connected to the fifth terminal electrode, the one end of the secondary winding is connected to the third terminal electrode, the other end of the secondary winding is connected to the sixth terminal electrode, and out of a center tap of the secondary winding, a part belonging to the first wire is connected to the fourth terminal electrode, and a part belonging to the second wire is connected to the first terminal electrode. Accordingly, a pair of balanced transmission lines connected to the secondary winding can be formed in parallel and linearly, and accordingly, the symmetry between the pair of balanced transmission lines can be secured. Further, it is not necessary to intersect the first and second wires, and thus the production is simplified.

Thus, according to the present invention, the symmetry between the two wires configuring the secondary winding is high, and thereby it is possible to provide a balun transformer with a good high-frequency characteristic, particularly with a good amplitude balance and phase balance in high frequency areas.

According to another embodiment thereof, the present invention is a balun transformer that includes a drum-shaped core having a core unit and first and second flanges arranged on both sides of the core unit; first to third terminal electrodes arranged on the first flange; fourth to sixth terminal electrodes arranged on the second flange; a first wire wound in a first number of turns around the core unit, the first wire having one end connected to the first terminal electrode and other end connected to the fourth terminal electrode; a second wire wound in a second number of turns around the core unit, the second wire having one end connected to the second terminal electrode and other end connected to the fifth terminal electrode, and a third wire wound in a third number of turns around the core unit, the third wire having one end connected to the third terminal electrode and other end connected to the sixth terminal electrode. The first number is different from the second and third numbers, and the second and third numbers are same as each other.

The first number may be larger than the second and third numbers. The first to third terminal electrodes may be arranged in this order as viewed from a predetermined direction on the first flange, and the fourth to sixth terminal electrodes may be arranged in different from this order as viewed from the predetermined direction on the second flange. The fourth, sixth, and fifth terminal electrodes may be arranged in this order as viewed from the predetermined direction on the second flange. The fifth, sixth, and fourth terminal electrodes may be arranged in this order as viewed from the predetermined direction on the second flange. The sixth, fifth, and fourth terminal electrodes may be arranged in this order as viewed from the predetermined direction on the second flange. The first to third terminal electrodes may be arranged in this order as viewed from a predetermined direction on the first flange, and the fourth to sixth terminal electrodes may be arranged in this order as viewed from the predetermined direction on the second flange. The second, first, and third terminal electrodes may be arranged in this order as viewed from a predetermined direction on the first flange, and the fifth, fourth, and sixth terminal electrodes may be arranged in this order as viewed from the predetermined direction on the second flange. The second wire and the third wire may be wound around the core unit so as to extend along each other.

Yet another embodiment of the present invention is a balun transformer that includes a drum-shaped core having a core unit and first and second flanges arranged on both sides of the core unit; a first electrode group arranged on the first flange constituted of a plurality of terminal electrodes arranged in line including at least a first terminal electrode located at a near end of the first electrode group viewed from a predetermined direction and a second terminal electrode located at a far end of the first electrode group viewed from the predetermined direction; a second electrode group arranged on the second flange constituted of a plurality of terminal electrodes arranged in line including at least a third terminal electrode located at a near end of the second electrode group viewed from the predetermined direction and a fourth terminal electrode located at a far end of the second electrode group viewed from the predetermined direction; a primary winding wound around the core unit, the primary winding having first and second ends; and a secondary winding wound around the core unit, the secondary winding having third and fourth ends and a center tap, the secondary winding including a first wire extending from the third end to the center tap and a second wire extending from the fourth end to the center tap. The first end of the primary winding is connected to the first terminal electrode, the second end of the primary winding is connected to one of the second and third terminal electrodes, the third end of the secondary winding is connected to other of the second and third terminal electrodes, the fourth end of the secondary winding is connected to the fourth terminal electrode, and the center tap of the secondary winding is connected to one or more of the terminal electrodes.

According to further embodiments, the first electrode group may further include a fifth terminal electrode located between the first and second terminal electrode, the second electrode group may further include a sixth terminal electrode located between the third and fourth terminal electrode, the second end of the primary winding may be connected to the third terminal electrode, the third end of the secondary winding may be connected to the second terminal electrode, the center tap belonging to the first wire may be connected to the sixth terminal electrode, and the center tap belonging to the second wire may be connected to the fifth terminal electrode. The primary winding may include a third wire extending from the first end to a relay point and a fourth wire extending from the second end to the relay point, the first electrode group may further include a seventh terminal electrode located between the first and fifth terminal electrode, the second electrode group may further include an eighth terminal electrode located between the third and sixth terminal electrode. The relay point belonging to the third wire may be connected to the eighth terminal electrode, and the relay point belonging to the fourth wire may be connected to the seventh terminal electrode. The second end of the primary winding may be connected to the second terminal electrodes, the third end of the secondary winding may be connected to the third terminal electrode, and the center tap of the secondary winding may be connected to the second terminal electrode. The primary winding may be wound on an outer circumferential side of the core unit, and the secondary winding may be wound on an inner circumferential side of the core unit. The first wire and the second wire may be wound around the core unit so as to extend along each other. The third wire and the fourth wire may be wound around the core unit so as to extend along each other.

According to a still further embodiment thereof, the present invention is a device having a circuit board and a balun transformer mounted on the circuit board, wherein the circuit board includes at least first to fourth land patterns, the balun transformer includes: a drum-shaped core having a core unit and a pair of flanges arranged on both sides of the core unit; a plurality of terminal electrodes arranged on the flanges; a primary winding wound around the core unit, both ends of the primary winding being connected to the terminal electrodes; and a secondary winding wound around the core unit, both ends and a center tap of the secondary winding being connected to the terminal electrodes, the terminal electrode connected to one end of the primary winding is connected to the first land pattern, the terminal electrode connected to other end of the primary winding is connected to the second land pattern, the terminal electrode connected to one end of the secondary winding is connected to the third land pattern, the terminal electrode connected to other end of the secondary winding is connected to the fourth land pattern, and the terminal electrode connected to the center tap of the secondary winding is connected to the second land pattern.

The secondary winding may include a first wire extending from the one end to the center tap, and a second wire extending from the other end to the center tap, and the terminal electrodes connected to the center tap of the secondary winding belonging to the first and second wires, respectively, may be connected via the fourth land pattern. The secondary winding may include a first wire extending from the one end to the center tap, and a second wire extending from the other end to the center tap, the center tap of the secondary winding belonging to the first wire and the center tap of the secondary winding belonging to the second wire may be electrically and physically connected to a same terminal electrode. The first wire and the second wire may be wound around the core unit so as to extend along each other.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will be explained below in detail with reference to the accompanying drawings.

Figure 1:
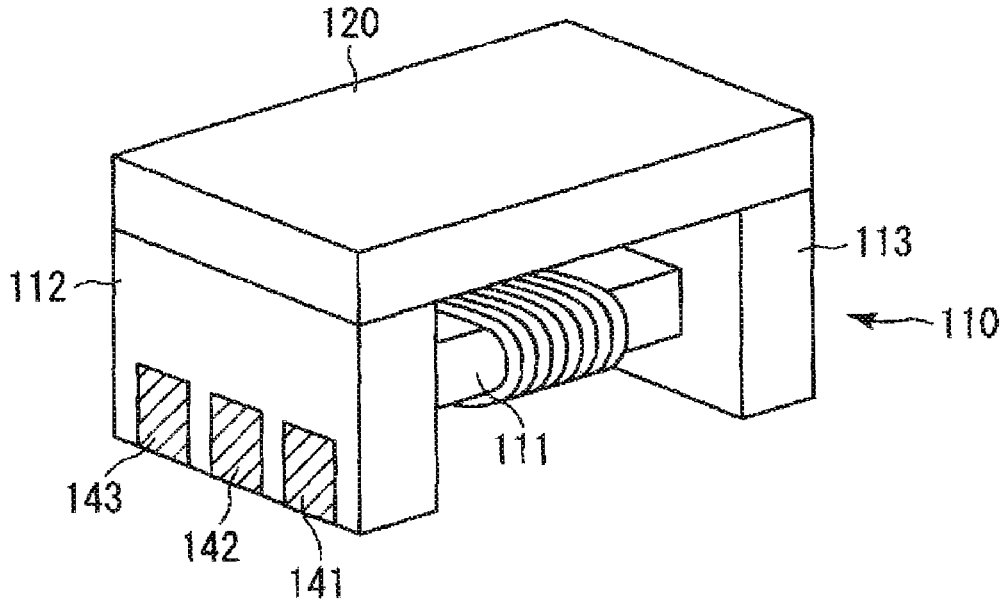
FIG. 1 is a schematic perspective view showing an appearance of a balun transformer according to a first embodiment of the present invention.
Figure 2:
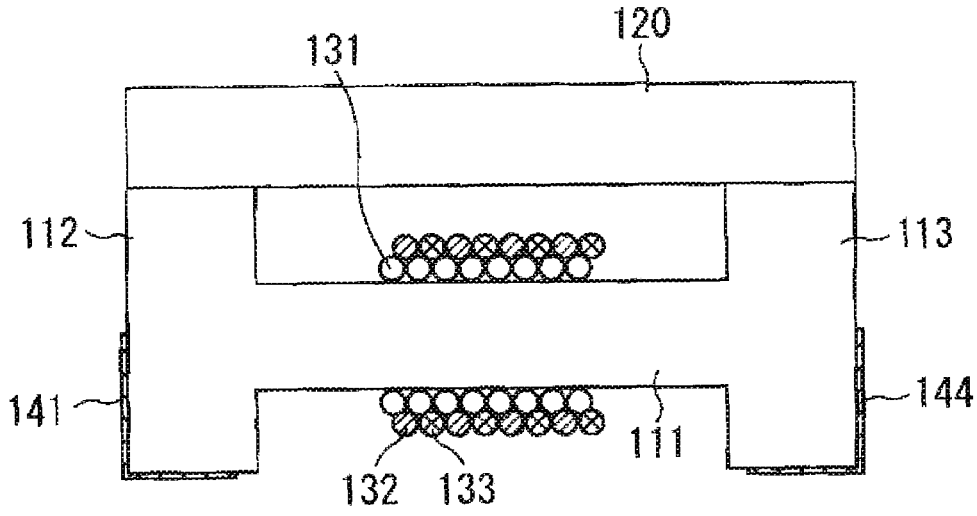
FIG. 2 is a schematic cross-sectional view of the balun transformer according to the first embodiment.
Figure 3:
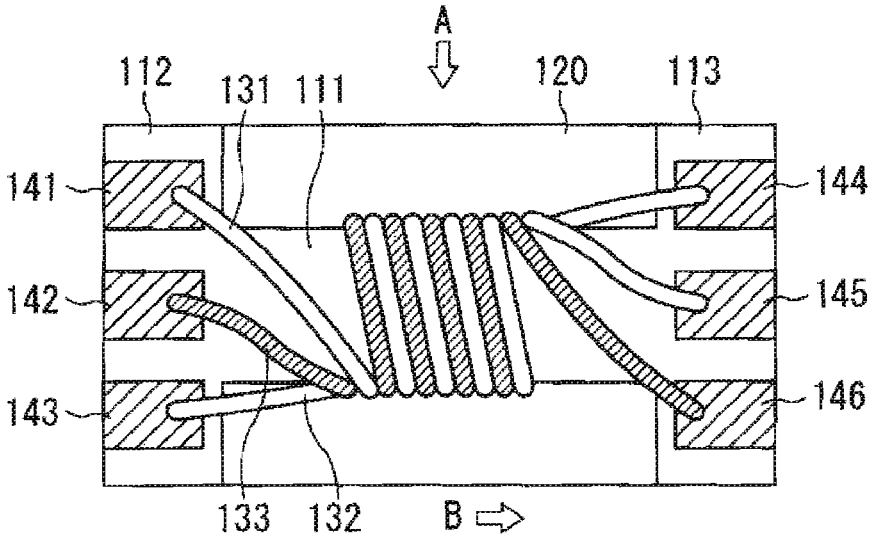
FIG. 3 is a schematic bottom view of the balun transformer according to the first embodiment, as viewed from a mounting surface side.

FIG. 1 is a schematic perspective view showing an appearance of a balun transformer according to a first embodiment of the present invention, FIG. 2 is a schematic cross-sectional view of the balun transformer according to the first embodiment, and FIG. 3 is a schematic bottom view of the balun transformer according to the first embodiment, as viewed from a mounting surface side.

As shown in FIG. 1 to FIG. 3, a balun transformer 100 according to the first embodiment is configured by a drum-shaped core 110, a plate-shaped core 120, and three wires 131 to 133. The drum-shaped core 110 includes a core unit 111, and a pair of flanges 112 and 113 arranged on both ends of the core unit 111. As viewed from one direction (from an arrow A shown in FIG. 3), three terminal electrodes 141 to 143 arranged in this order are positioned on one flange 112. As viewed from the same direction (from the arrow A shown in FIG. 3), three terminal electrodes 144 to 146 arranged in this order are positioned on the other flange 113.

The plate-shaped core 120 is located to link the top of the flanges 112 and 113 of the drum-shaped core 110. In the present invention, it is not essential to use the plate-shaped core 120, however, when a closed magnetic circuit is formed by using the plate-shaped core 120, high magnetic coupling can be obtained. The drum-shaped core 110 and the plate-shaped core 120 are made from magnetic materials, and although not particularly limited, it is preferable to use a NiZn ferrite material. The reason for the use of the NiZn ferrite is that it provides not only a comparatively high magnetic permeability, but also has low electro-conductivity. Thus, with this material, it becomes possible to directly form the terminal electrodes. However, in a case of the plate-shaped core 120 on which the terminal electrodes are not formed, it is also possible to use a MgZn ferrite material, which has an even higher magnetic permeability.

Figure 4:
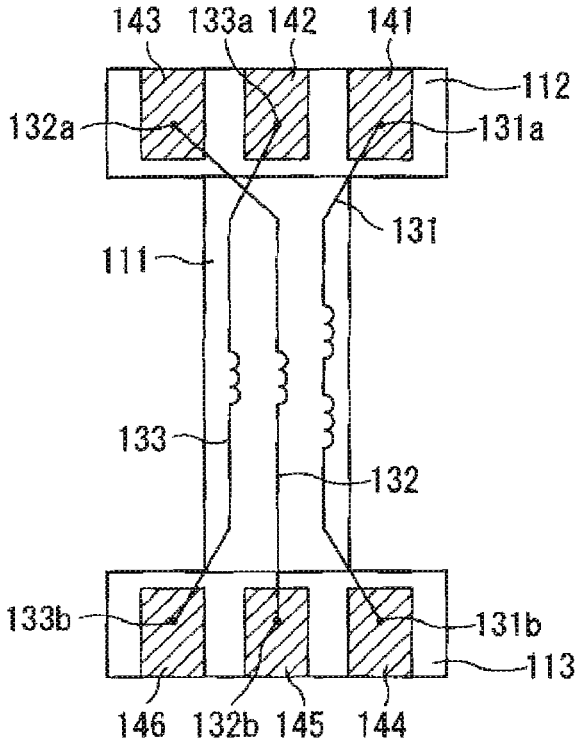
FIG. 4 is a schematic diagram for explaining a connection relationship among the wires 131 to 133 and the terminal electrodes 141 to 146.

As shown in FIG. 3, all the three wires 131 to 133 are wound in a clock-wise direction (right turn) towards an arrow B. FIG. 4 is a schematic diagram for explaining a connection relationship among the wires 131 to 133 and the terminal electrodes 141 to 146. As shown in FIG. 4, one end 131*a* of the wire 131 is connected to the terminal electrode 141, and the other end 131*b* is connected to the terminal electrode 144. In the first embodiment, the wire 131 is wound in eight turns. Further, one end 132*a* of the wire 132 is connected to the terminal electrode 143, and the other end 132*b* is connected to the terminal electrode 145. In the first embodiment, the wire 132 is wound in four turns. Further, one end 133*a* of the wire 133 is connected to the terminal electrode 142, and the other end 133*b* is connected to the terminal electrode 146. In the first embodiment, the wire 133 is wound in four turns.

Figure 5:
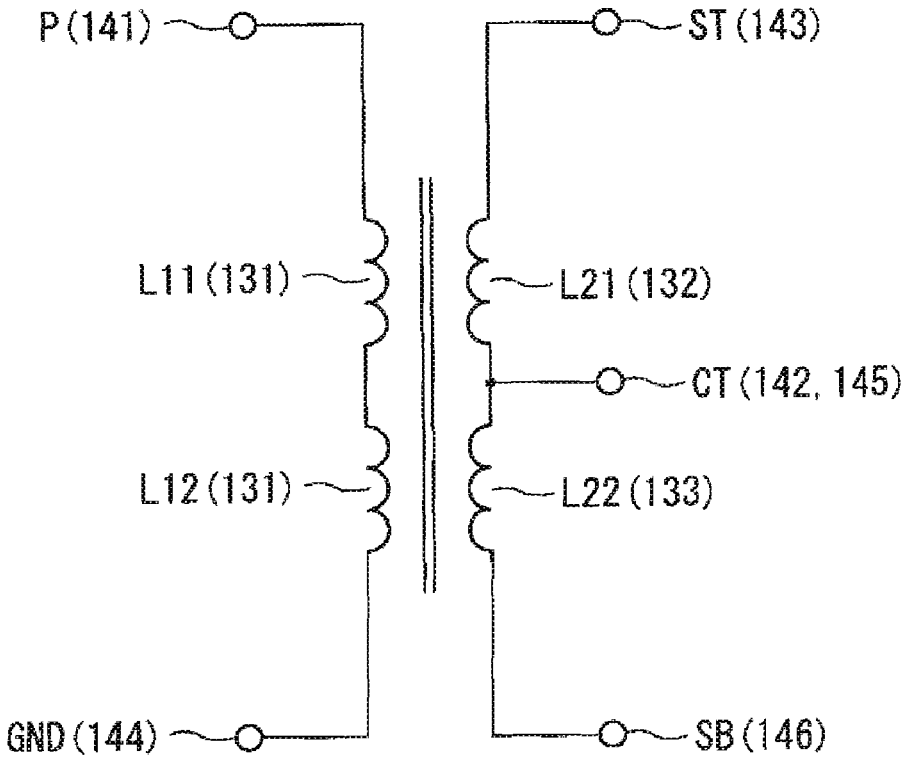
FIG. 5 is an equivalent circuit diagram of the balun transformer 100 according to the first embodiment.

FIG. 5 is an equivalent circuit diagram of the balun transformer 100 according to the first embodiment.

As shown in FIG. 5, the balun transformer 100 is configured by primary windings L11 and L12 connected between a primary-side terminal P and a ground terminal GND, and secondary windings L21 and L22 connected between a secondary-side positive electrode terminal ST and a secondary-side negative electrode terminal SB. A connecting point of the secondary windings L21 and L22 is used as a center tap CT.

In the first embodiment, the four turns on the one end 131*a* side of the wire 131 configure the primary winding L11, and the four turns on the other end 131*b* side configure the primary winding L12. Further, the wire 132 configures the secondary winding L21, while the wire 133 configures the secondary winding L22. Accordingly, the terminal electrode 141 is used as the primary-side terminal P, the terminal electrodes 143 and 146 are respectively used as the secondary-side positive electrode terminal ST and the secondary-side negative electrode terminal SB, the terminal electrode 144 is used as the ground terminal GND, and the terminal electrodes 142 and 145 are used as the center tap CT.

As shown in FIG. 2 and FIG. 3, in the first embodiment, the wire 131 that configures the primary winding is wound on the inner circumferential side, and the wires 132 and 133 configuring the secondary winding are wound on the outer circumferential side. Note that these wires can be wound in the opposite manner. The wires 132 and 133 configuring the secondary winding are wound by bifilar winding around the core unit 111. In FIG. 2, a wire that is hatched on the cross section is the wire 132, and a wire that is marked with "x" on the cross section is the wire 133. That is, the wires 132 and 133 are wound alternately from one flange 112 towards the other flange 113 (or towards the opposite direction). Accordingly, parts coinciding with an n-th turn (n=1 to 4) of the wires 132 and 133 are adjoined to each other.

Figure 6:
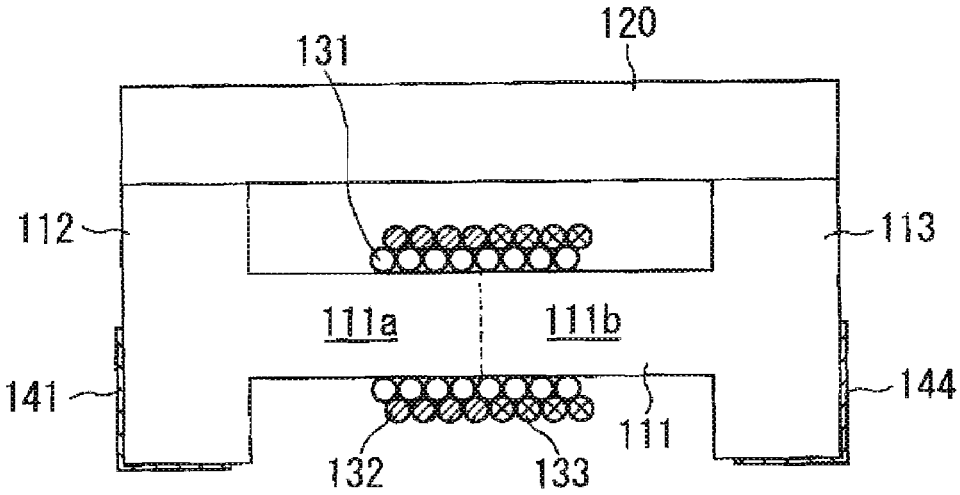
FIG. 6 is a schematic cross-sectional view of a balun transformer according to a comparative example.

According to such a winding method, a remarkably high level of symmetry can be secured between these two wires 132 and 133, as compared to a case of a so-called sector winding, i.e., the wire 132 is collectively wound in an area 111*a* on the flange 112 side in the core unit 111 and the wire 133 is collectively wound in an area 111*b* on the flange 113 side in the core unit 111 as shown in a comparative example shown in FIG. 6 is performed. This is because in contrast to the bifilar winding in which the two wires are wound almost equally, in the sector winding, a part that works as the center tap CT is positioned at the center of the core unit 111, and accordingly, the symmetry becomes disturbed at the wiring part, which is used for connecting the center tap CT to the terminal electrodes.

Figure 7:
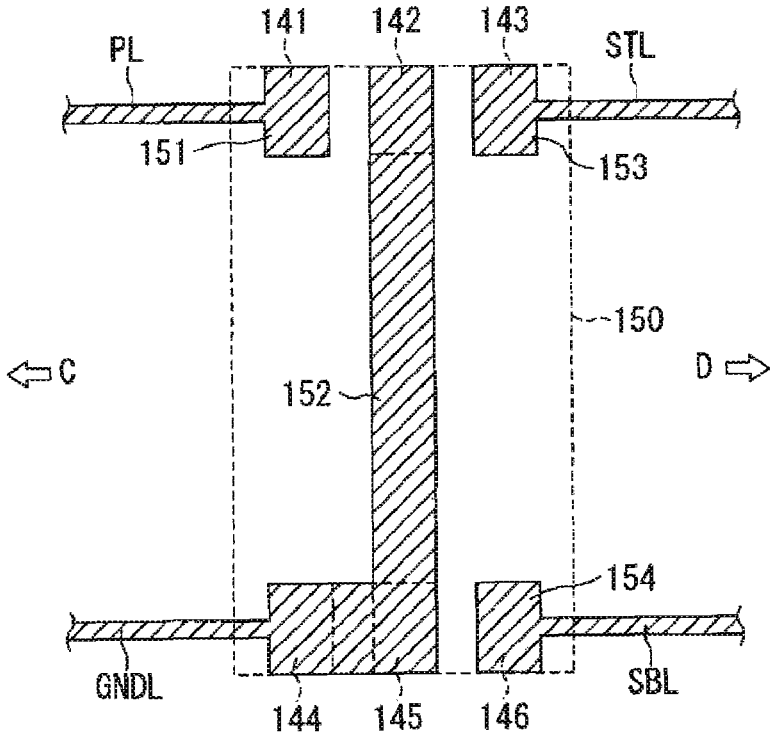
FIG. 7 is a diagram showing a wiring pattern on a printed-circuit board for mounting the balun transformer 100.

FIG. 7 shows a wiring pattern on a printed-circuit board for mounting the balun transformer 100 according to the first embodiment.

A mount region 150 on a printed-circuit board shown in FIG. 7 is a region for mounting the balun transformer 100, and is arranged thereon with four land patterns 151 to 154. The land pattern 151 is a pattern connected to the unbalanced transmission line PL, and is connected to the terminal electrode 141 (the primary-side terminal P) of the balun transformer 100. The land pattern 152 is a pattern connected to the ground wiring GNDL, and is commonly connected to the terminal electrode 144 (the ground terminal GND) and the terminal electrodes 142 and 145 (the center tap CT) of the balun transformer 100. The land patterns 153 and 154 are patterns connected to a pair of balanced transmission lines STL and SBL, and are respectively connected to the terminal electrode 143 (the secondary-side positive electrode terminal ST) and the terminal electrode 146 (the secondary-side negative electrode terminal SB) of the balun transformer 100.

Because of such a layout, the unbalanced transmission line PL can be formed linearly in the direction of an arrow C, as viewed from the mount region 150, and at the same time, the pair of balanced transmission lines STL and SBL can be formed in parallel and linearly to each other in the direction of an arrow D, as viewed from the mount region 150. Thereby, it becomes unnecessary, for example, to detour the wiring pattern on the printed-circuit board, and thus the area occupied by the wiring pattern does not increase beyond the required limit. Further, the symmetry of the wiring pattern can be secured. This enables downsizing of the entire device, as well as the improvement in the signal quality.

Thus, the balun transformer 100 employs bifilar winding for the two wires 132 and 133 configuring the secondary winding, and accordingly, as compared to a case that these are wound by the sector winding, a remarkably high level of symmetry can be secured between these two wires configuring the secondary winding. As a result, particularly in high frequency areas, it is possible to achieve a good amplitude balance and phase balance.

Further, because all the wires 131 to 133 are wound in the same direction, it is not necessary to wind while intersecting the wires in the core unit 111. Thereby, short circuits hardly occur, and improvement in the reliability of the product can be also achieved.

A second embodiment of the present invention is described next.

Figure 8:
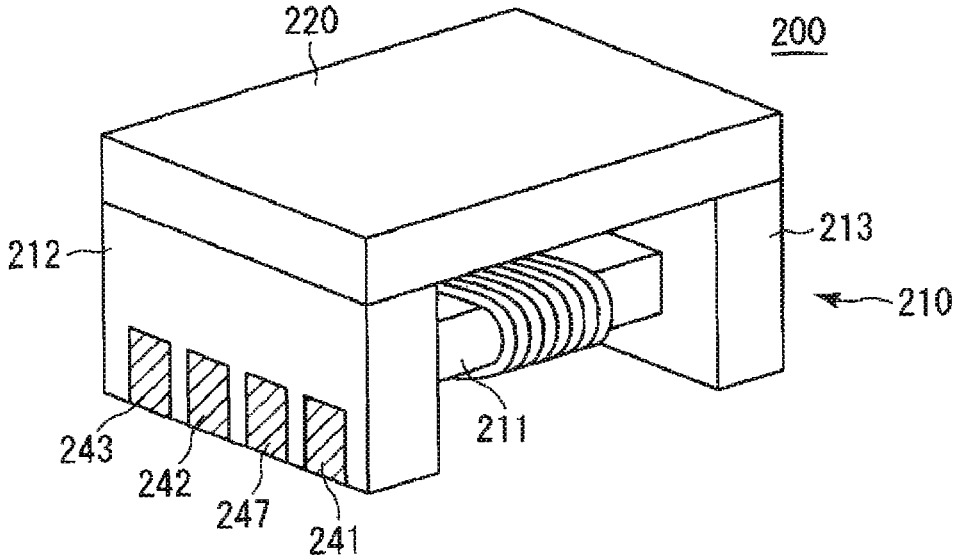
FIG. 8 is a schematic perspective view showing an appearance of a balun transformer according to the second embodiment.
Figure 9:
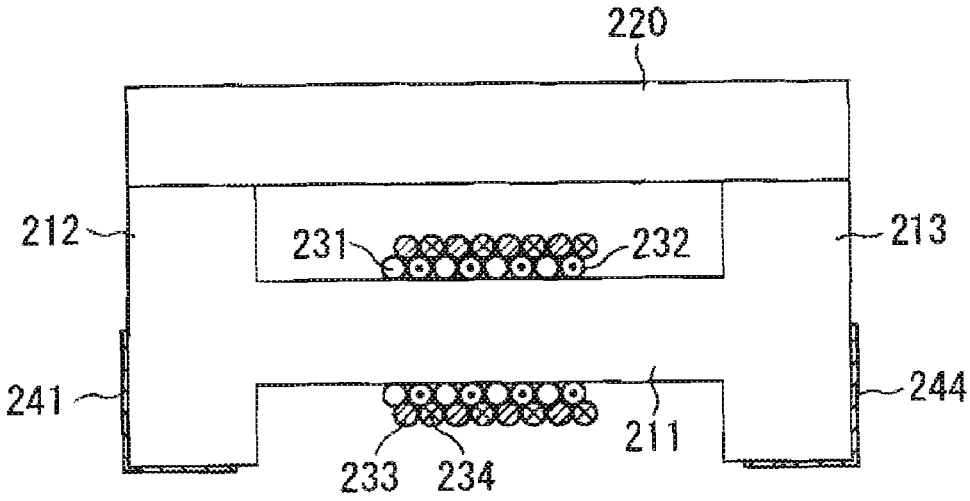
FIG. 9 is a schematic cross-sectional view of the balun transformer according to the second embodiment.
Figure 10:
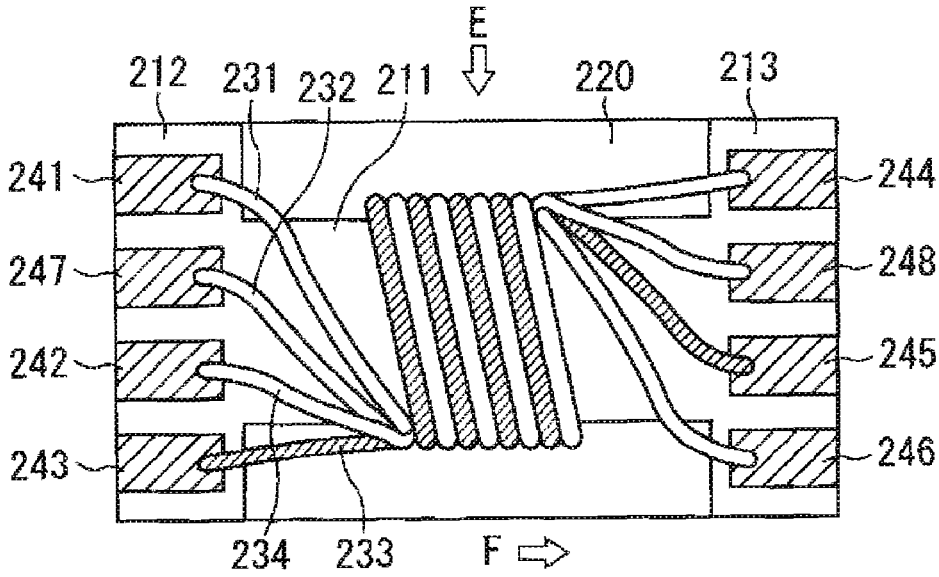
FIG. 10 is a schematic bottom view of the balun transformer according to the second embodiment, as viewed from a mounting surface side.

FIG. 8 is a schematic perspective view showing an appearance of a balun transformer according to the second embodiment, FIG. 9 is a schematic cross-sectional view of the balun transformer according to the second embodiment, and FIG. 10 is a schematic bottom view of the balun transformer according to the second embodiment, as viewed from a mounting surface side.

As shown in FIG. 8 to FIG. 10, a balun transformer 200 according to the second embodiment is configured by a drum-shaped core 210, a plate-shaped core 220, and four wires 231 to 234. The drum-shaped core 210 includes a core unit 211, and a pair of flanges 212 and 213 arranged on both ends of the core unit 211. The drum-shaped core 210 and the plate-shaped core 220 correspond to the drum-shaped core 110 and the plate-shaped core 120 in the balun transformer 100, and thus the materials are also the same as those described above.

As viewed from one direction (from an arrow E shown in FIG. 10), four terminal electrodes 241, 247, 242, and 243 located in this order are arranged on one flange 212 of the drum-shaped core 210. As viewed from the same direction (from the arrow E shown in FIG. 10), four terminal electrodes 244, 248, 245, and 246 located in this order are arranged on the other flange 213. Among these, the terminal electrodes 241 to 246 correspond to the terminal electrodes 141 to 146 in the balun transformer 100. Accordingly, the balun transformer 200 has a configuration in which the two terminal electrodes 247 and 248 are added to the balun transformer 100.

Figure 11:
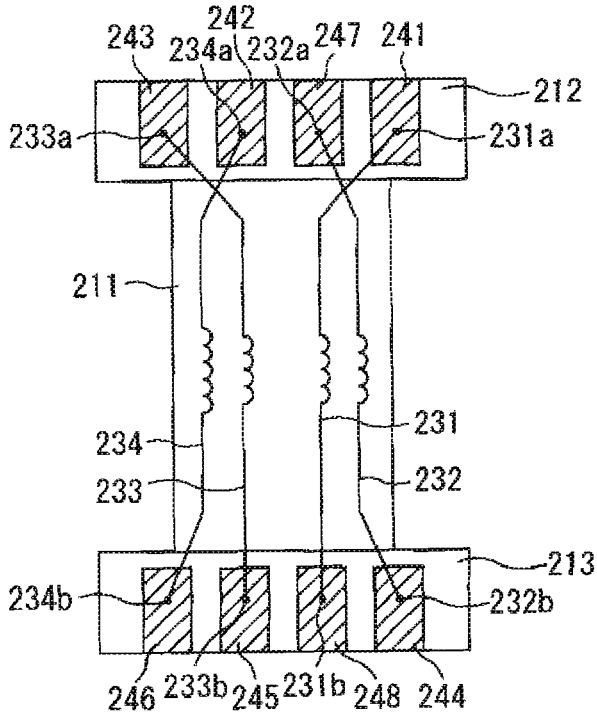
FIG. 11 is a schematic diagram for explaining a connection relationship among the wires 231 to 234 and the terminal electrodes 241 to 248.

As shown in FIG. 10, all the four wires 231 to 234 are wound in a clock-wise direction (right turn) towards an arrow F. FIG. 11 is a schematic diagram for explaining a connection relationship among the wires 231 to 234 and the terminal electrodes 241 to 248. As shown in FIG. 11, one end 231*a* of the wire 231 is connected to the terminal electrode 241, and the other end 231*b* is connected to the terminal electrode 248. One end 232*a* of the wire 232 is connected to the terminal electrode 247, and the other end 232*b* is connected to the terminal electrode 244. One end 233*a* of the wire 233 is connected to the terminal electrode 243, and the other end 233*b* is connected to the terminal electrode 245. Further, one end 234*a* of the wire 234 is connected to the terminal electrode 242, and the other end 234*b* is connected to the terminal electrode 246. In the second embodiment, all the wires 231 to 234 are wound in four turns.

Figure 12:
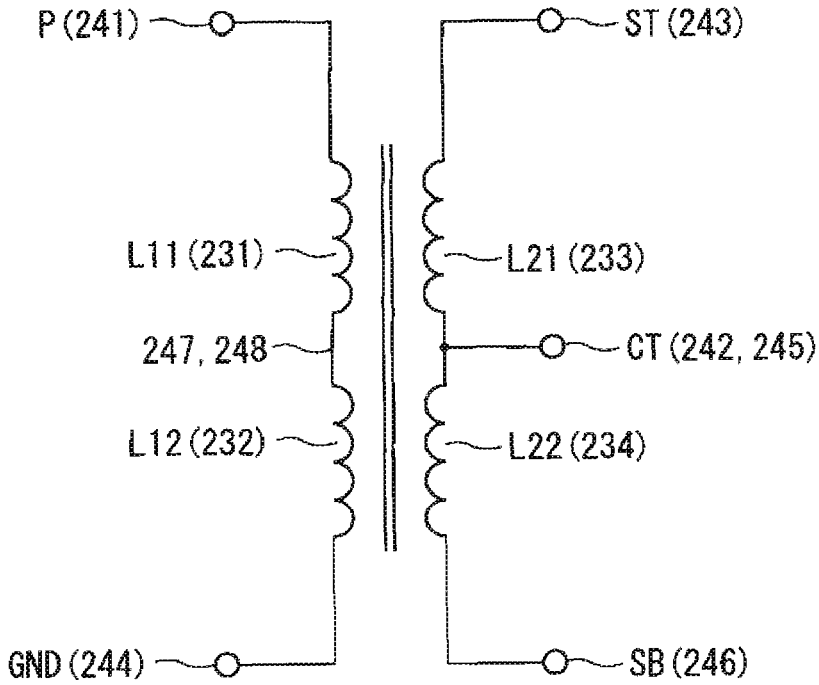
FIG. 12 is an equivalent circuit diagram of the balun transformer 200 according to the second embodiment.

FIG. 12 is an equivalent circuit diagram of the balun transformer 200 according to the second embodiment.

As shown in FIG. 12, the equivalent circuit of the balun transformer 200 is basically the same as that shown in FIG. 5. However, the primary windings L11 and L12 are configured by the wires 231 and 232 different from each other and these are connected by terminal electrodes 247 and 248 that act as the relay points. Further, like in the equivalent circuit shown in FIG. 5, the terminal electrode 241 is used as the primary-side terminal P, the terminal electrodes 243 and 246 are respectively used as the secondary-side positive electrode terminal ST and the secondary-side negative electrode terminal SB, the terminal electrode 244 is used as the ground terminal GND, and the terminal electrodes 242 and 245 are used as the center tap CT.

As shown in FIG. 9 and FIG. 10, also in the second embodiment, the wires 231 and 232 configuring the primary winding are wound on the inner circumferential side, and the wires 233 and 234 configuring the secondary winding are wound on the outer circumferential side. Note that these wires are wound in the opposite manner. In the second embodiment, not only the wires 233 and 234 configuring the secondary winding but also the wires 231 and 232 configuring the primary winding are wound by bifilar winding around the core unit 211. In FIG. 9, a wire that is neither hatched nor marked with a symbol on the cross section is the wire 231, a wire that is marked with "•" (solid circle) on the cross section is the wire 232, a wire that is hatched on the cross section is the wire 233, and a wire that is marked with "x" on the cross section is the wire 234. That is, the balun transformer 200 has a configuration such that the wires 231 and 232 are wound alternately from one flange 212 towards the other flange 213 (towards the opposite direction), and at the same time, the wires 233 and 234 are wound alternately.

Figure 13A:
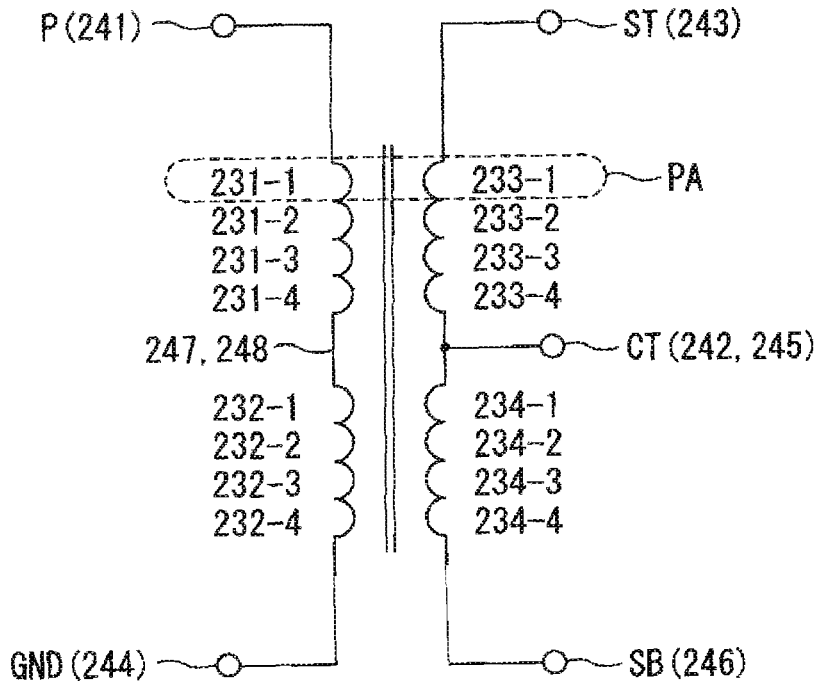
FIG. 13A is a circuit diagram showing a relationship between each turn of the wires 231 to 234 and the terminals.
Figure 13B:
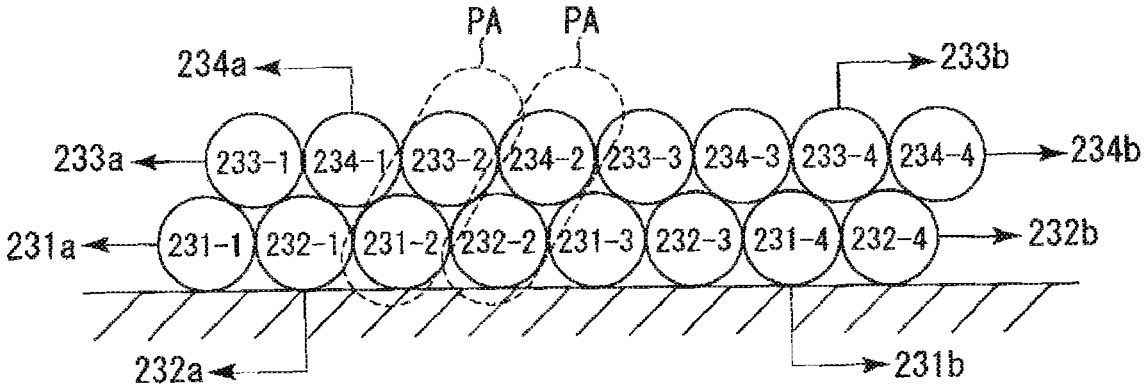
FIG. 13B is a schematic partial sectional view showing the arrangement of the wires 231 to 234 in each turn.

FIG. 13A and FIG. 13B explain the arrangement of the wires 231 to 234 in more detail, where FIG. 13A is a circuit diagram showing a relationship between each turn of the wires 231 to 234 and the terminals, and FIG. 13B is a schematic partial sectional view showing the arrangement of the wires 231 to 234 in each turn. In FIGS. 13A and 13B, numbers displayed before hyphens indicate types of wire, and numbers displayed after the hyphen indicate the number of turns. For example, a part assigned with reference numeral 231-1 indicates a first turn of the wire 231.

As shown in FIG. 13A, the number of times of turns for the wire 231 is defined by assuming the terminal electrode 241 (the primary-side terminal P) as a starting point, the number of times of turns for the wire 232 is defined by assuming the terminal electrode 247 (relay point) as a starting point, the number of times of turns for the wire 233 is defined by assuming the terminal electrode 243 (the secondary-side positive electrode terminal ST) as a starting point, and the number of times of turns for the wire 234 is defined by assuming the terminal electrode 242 (the center tap CT) as a starting point. Thereby, as viewed from the corresponding terminal electrodes (241 and 243), each turn 231-1 to 231-4 of the wire 231 and each turn 233-1 to 233-4 of the wire 233 configure a pair PA to each other. Similarly, as viewed from the corresponding terminal electrodes (244 and 246), each turn 232-1 to 232-4 of the wire 232 and each turn 234-1 to 234-4 of the wire 234 configure a pair PA to each other. In this case, the pair PA is the corresponding turn for a pair of wires, and is a portion in which the phases of transmitted signals should coincide.

As shown in FIG. 13B, it is understood that in the parts in which the number of times of turns is the same with each other (that is, a pair PA) as viewed from the corresponding terminal electrodes, the primary and secondary windings are adjoining at the top and bottom. That is, each wire is adjoining in, the portion in which the phases of transmitted signals should coincide, and thus the magnetic coupling of the primary and secondary windings can be enhanced, and a better high-frequency characteristic can be obtained.

Figure 14:
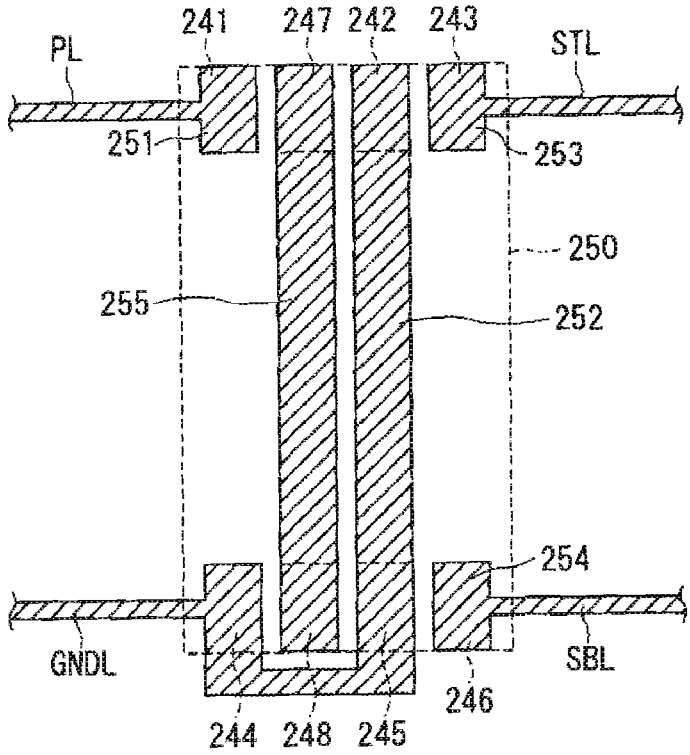
FIG. 14 shows a wiring pattern on a printed-circuit board for mounting the balun transformer 200.

FIG. 14 shows a wiring pattern on a printed-circuit board for mounting the balun transformer 200.

Amount region 250 on the printed-circuit board shown in FIG. 14 is a region for mounting the balun transformer 200, and is arranged with five land patterns 251 to 255. The land pattern 251 is a pattern connected to the unbalanced transmission line PL, and is connected to the terminal electrode 241 (the primary-side terminal P) of the balun transformer 200. The land pattern 252 is a pattern connected to the ground wiring GNDL, and is commonly connected to the terminal electrode 244 (the ground terminal GND) and the terminal electrodes 242 and 245 (the center tap CT) of the balun transformer 200. The land patterns 253 and 254 are patterns connected to a pair of balanced transmission lines STL and SBL, and are respectively connected to the terminal electrode 243 (the secondary-side positive electrode terminal ST) and the terminal electrode 246 (the secondary-side negative electrode terminal SB) of the balun transformer 200. Further, the land pattern 255 is a pattern connected to a relay point of the primary winding, and is commonly connected to the terminal electrodes 247 and 248 of the balun transformer 200.

According to such a layout, similarly to the balun transformer 100 according to the first embodiment, it becomes unnecessary, for example, to detour the wiring pattern on the printed-circuit board, and thus the area occupied by the wiring pattern does not increase beyond the required limit, and further, the symmetry of the wiring pattern can be secured. This enables the downsizing of the entire device, as well as the improvement in signal quality.

Thus, according to the balun transformer 200 of the second embodiment, in addition to the same effects as that of the balun transformer 100 according to the first embodiment, the magnetic coupling of the primary and secondary windings can be further enhanced, which enables the achievement of a better high-frequency characteristic. Further, because the number of times of windings of the wires 231 to 234 is the same with each other, all these four wires 231 to 234 can be wound simultaneously.

A third embodiment of the present invention is described next.

Figure 15:
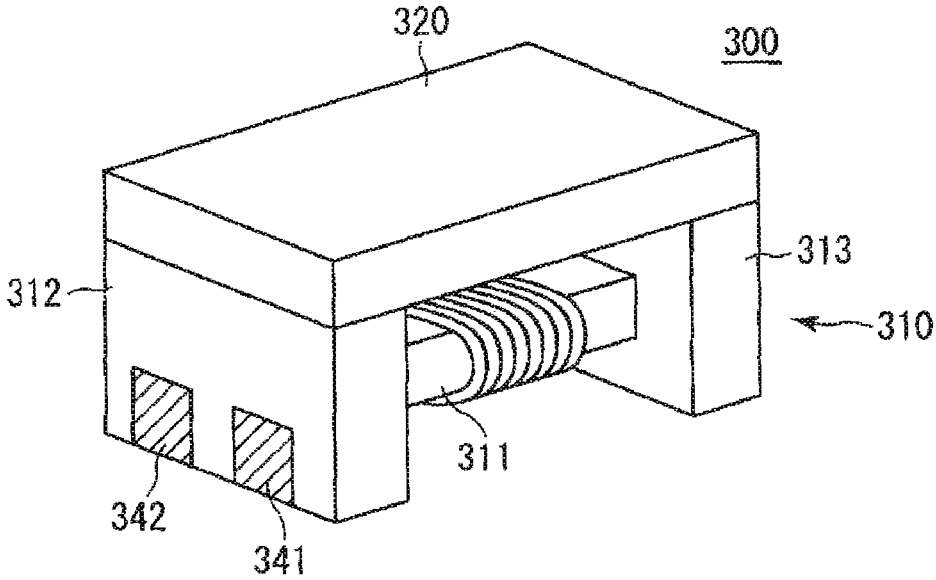
FIG. 15 is a schematic perspective view showing an appearance of a balun transformer according to the third embodiment.
Figure 16:
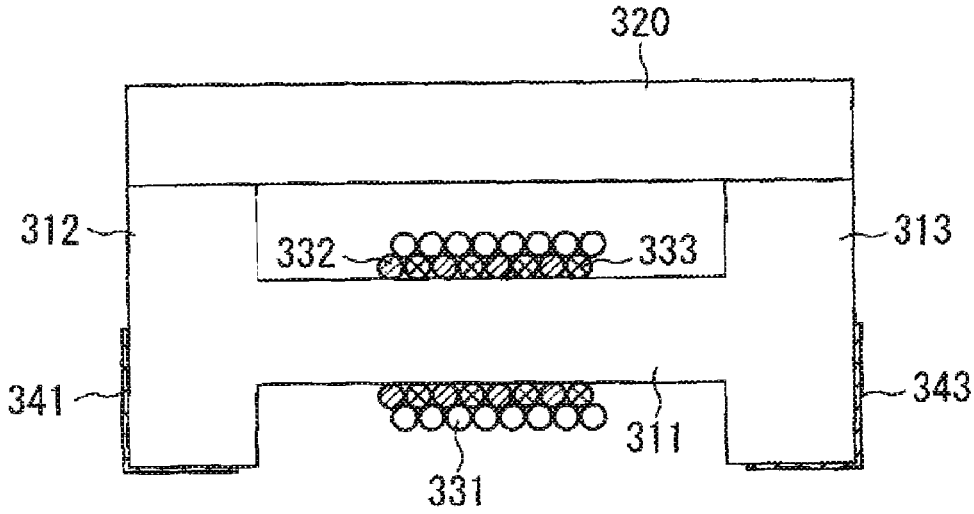
FIG. 16 is a schematic cross-sectional view of the balun transformer according to the third embodiment.

FIG. 15 is a schematic perspective view showing an appearance of a balun transformer according to the third embodiment. FIG. 16 is a schematic cross-sectional view of the balun transformer according to the third embodiment, and FIG. 17 is a schematic bottom view of the balun transformer according to the third embodiment, as viewed from the mounting surface side.

Figure 17:
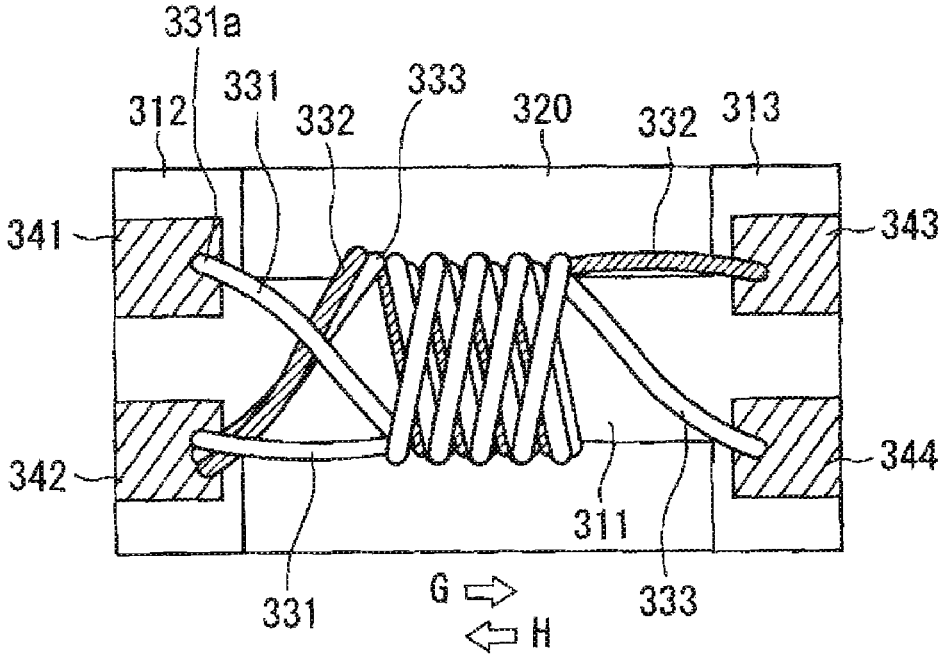
FIG. 17 is a schematic bottom view of the balun transformer according to the third embodiment, as viewed from the mounting surface side.

As shown in FIG. 15 to FIG. 17, a balun transformer 300 according to the third embodiment is configured by a drum-shaped core 310, a plate-shaped core 320, and three wires 331 to 333. The drum-shaped core 310 includes a core unit 311, and a pair of flanges 312 and 313 arranged on both ends of the core unit 311. The drum-shaped core 310 and the plate-shaped core 320 correspond to the drum-shaped core 110 and the plate-shaped core 120 in the balun transformer 100, and accordingly, the materials are also the same as those described above.

Two terminal electrodes 341 and 342 are arranged on one flange 312 of the drum-shaped core 310, and two terminal electrodes 343 and 344 are arranged on the other flange 313. As shown in FIG. 17, all the three wires 331 to 333 are wound in a clock-wise direction (right turn) towards an arrow G. Note that, with respect to the wire 331, after four turns are wound from one end 331*a* in the direction of an arrow G, four turns are wound in the direction of an arrow H, in the form of return winding. Thus, the wire 331 intersects itself at some parts.

Figure 18:
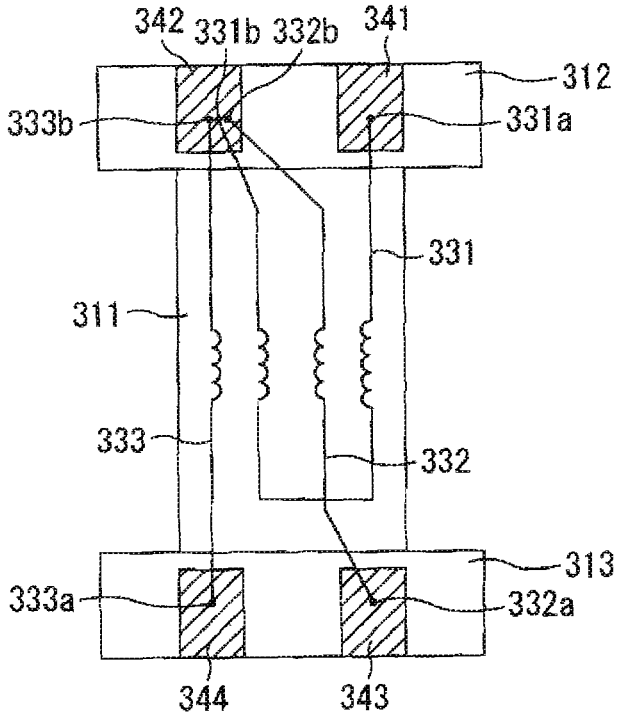
FIG. 18 is a schematic diagram for explaining a connection relationship among the wires 331 to 333 and the terminal electrodes 341 to 344.

FIG. 18 is a schematic diagram for explaining a connection relationship among the wires 331 to 333 and the terminal electrodes 341 to 344. As shown in FIG. 18, one end 331*a* of the wire 331 is connected to the terminal electrode 341, and the other end 331*b* is connected to the terminal electrode 342. One end 332*a* of the wire 332 is connected to the terminal electrode 343, and the other end 332*b* is connected to the terminal electrode 342. Further, one end 333*a* of the wire 333 is connected to the terminal electrode 344, and the other end 333*b* is connected to the terminal electrode 342. In the third embodiment, the wire 331 is wound in eight turns, while the wires 332 and 333 are wound in four turns each.

Figure 19:
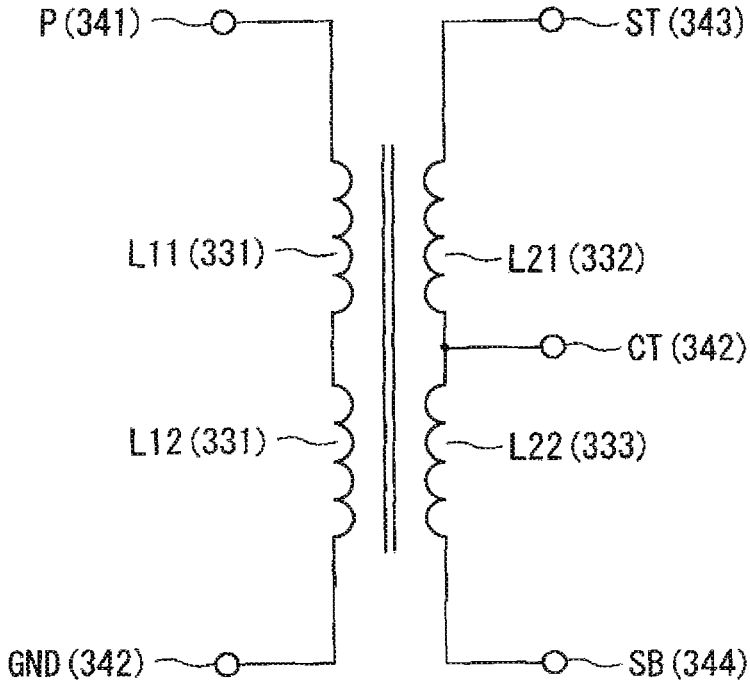
FIG. 19 is an equivalent circuit diagram of the balun transformer 300 according to the third embodiment.

FIG. 19 is an equivalent circuit diagram of the balun transformer 300 according to the third embodiment.

As shown in FIG. 19, the equivalent circuit of the balun transformer 300 is basically the same as that shown in FIG. 5. However, the terminal electrode 342 is used as both the ground terminal GND and the center tap CT. Further, the terminal electrode 341 is used as the primary-side terminal P, and the terminal electrodes 343 and 344 are respectively used as the secondary-side positive electrode terminal ST and the secondary-side negative electrode terminal SB.

As shown in FIG. 16 and FIG. 17, also in the third embodiment, the wire 331 configuring the primary winding is wound on the outer circumferential side, and the wires 332 and 333 configuring the secondary winding are wound on the inner circumferential side. This is because the wire 331 intersects itself at some parts, and accordingly, the surface after winding is roughened, and when the secondary winding (the wires 332 and 333) is wound on such a roughened surface, stress is applied to the intersecting part.

Also in the third embodiment, the wires 332 and 333 configuring the secondary winding are wound by bifilar winding around the core unit 311. In FIG. 16, a wire that is hatched on the cross section is the wire 332, and a wire that is marked with "x" on the cross section is the wire 333. That is, the wires 332 and 333 are wound alternately from one flange 312 towards the other flange 313 (or towards the opposite direction).

Figure 20:
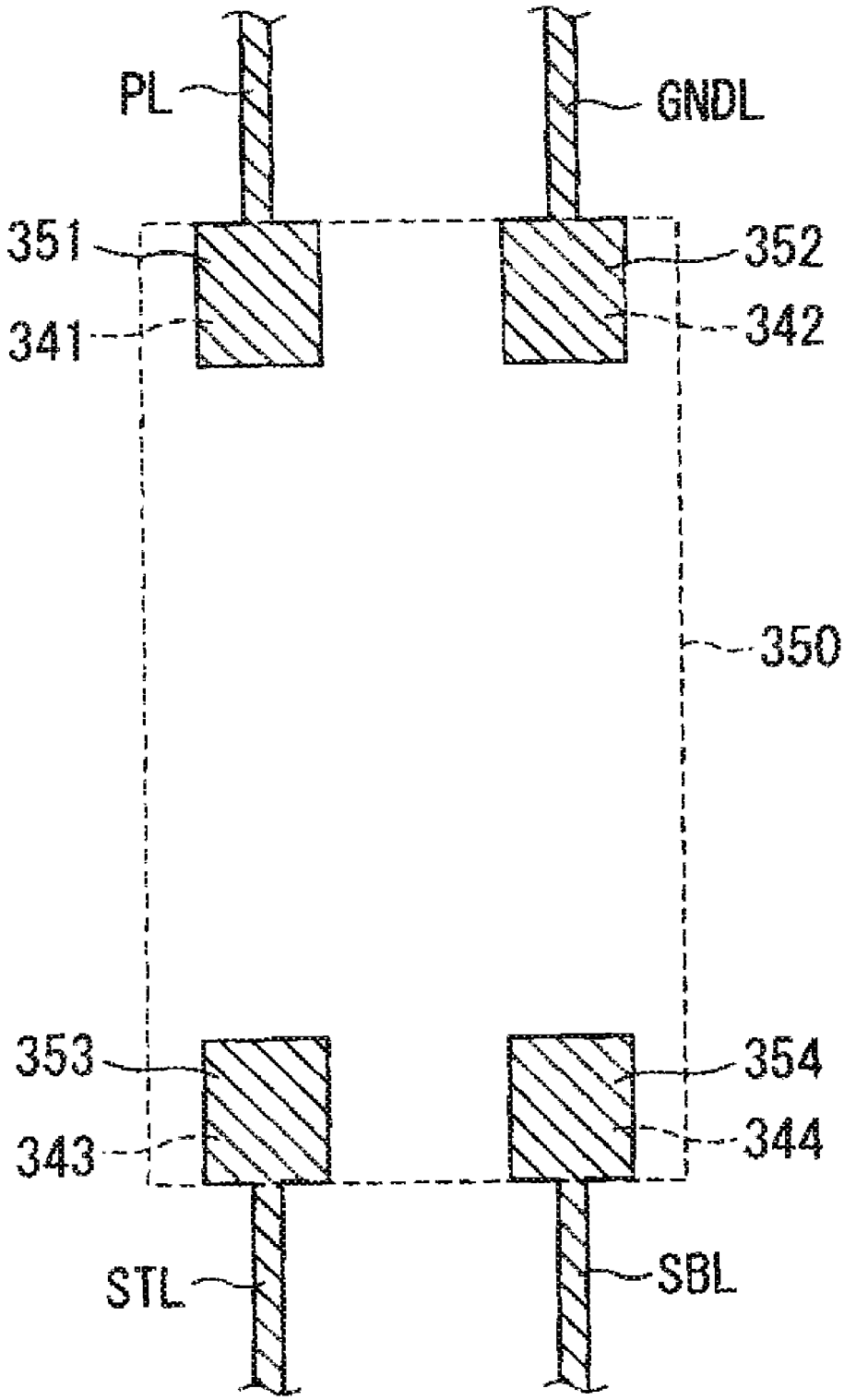
FIG. 20 shows a wiring pattern on the printed-circuit board for mounting the balun transformer 300 according to the third embodiment.

FIG. 20 shows a wiring pattern on the printed-circuit board for mounting the balun transformer 300 according to the third embodiment.

A mount region 350 on the printed-circuit board shown in FIG. 20 is a region for mounting the balun transformer 300, and arranged with four land patterns 351 to 354. The land pattern 351 is a pattern connected to the unbalanced transmission line PL, and is connected to the terminal electrode 341 (the primary-side terminal P) of the balun transformer 300. The land pattern 352 is a pattern connected to the ground wiring GNDL, and is connected to the terminal electrode 342 (that serves both the ground terminal GND and the center tap CT) of the balun transformer 300. The land patterns 353 and 354 are patterns connected to a pair of balanced transmission lines STL and SBL, and are respectively connected to the terminal electrode 343 (the secondary-side positive electrode terminal ST) and the terminal electrode 344 (the secondary-side negative electrode terminal SB) of the balun transformer 300.

According to such a layout, similarly to the balun transformer 100 and the balun transformer 200, it becomes unnecessary, for example, to detour the wiring pattern on the printed-circuit board, and thus the area occupied by the wiring pattern does not increase beyond the required limit, and further, the symmetry of the wiring pattern can be secured. This enables the downsizing of the entire device, as well as the improvement in the signal quality.

As described above, according to the balun transformer 300, in addition to the effects identical to that of the balun transformer 100 according to the first embodiment, the number of terminal electrodes can be reduced to four, and thus the further downsizing can be achieved.

A fourth embodiment of the present invention is described next.

Figure 21:
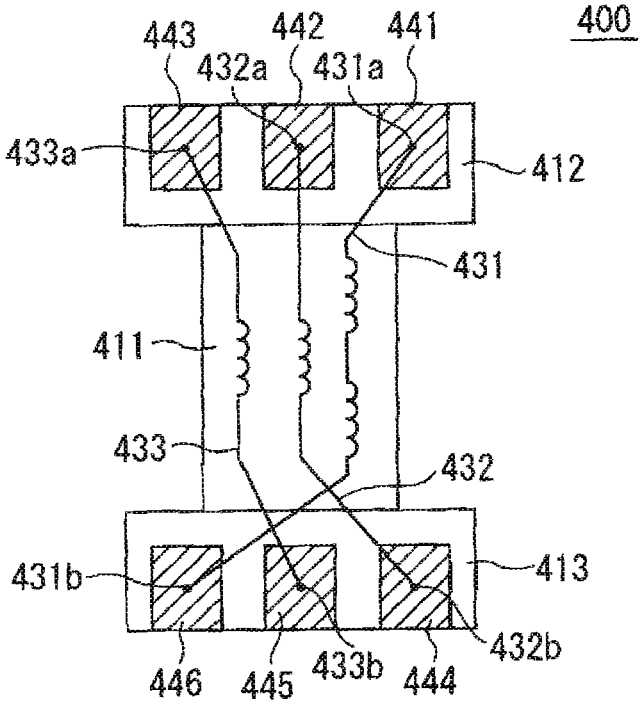
FIG. 21 is a schematic diagram for explaining a connection relationship between the wires and the terminal electrodes of a balun transformer 400 according to the fourth embodiment.

FIG. 21 is a schematic diagram for explaining a connection relationship between the wires and the terminal electrodes of a balun transformer 400 according to the fourth embodiment. The appearance and the cross section of the balun transformer 400 according to the fourth embodiment are substantially identical to those of the balun transformer 100 according to the first embodiment shown in FIG. 1 and FIG. 2.

As shown in FIG. 21, three wires 431 to 433 are connected to the terminal electrodes 441 to 446 in the fourth embodiment. Among these, the wire 431 configures the primary winding, and the wires 432 and 433 configure the secondary winding. One end 431*a* of the wire 431 is connected to the terminal electrode 441, and the other end 431*b* is connected to the terminal electrode 446. One end 432*a* of the wire 432 is connected to the terminal electrode 442, and the other end 432*b* is connected to the terminal electrode 444. One end 433*a* of the wire 433 is connected to the terminal electrode 443, and the other end 433*b* is connected to the terminal electrode 445. In the fourth embodiment, the wire 431 is wound in eight turns, while the wires 432 and 433 are wound in four turns each. Further, the equivalent circuit of the balun transformer 400 is the same as that shown in FIG. 5.

Figure 22:
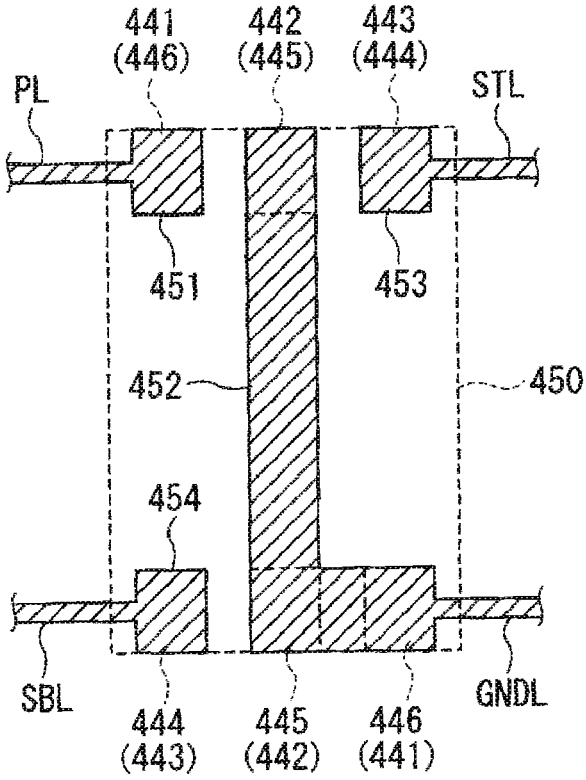
FIG. 22 shows a wiring pattern on the printed-circuit board for mounting the balun transformer 400 according to the fourth embodiment.

FIG. 22 shows a wiring pattern on the printed-circuit board for mounting the balun transformer 400 according to the fourth embodiment.

A mount region 450 on the printed-circuit board shown in FIG. 22 is a region for mounting the balun transformer 400, and is arranged with four land patterns 451 to 454. The land pattern 451 is a pattern connected to the unbalanced transmission line PL, and is connected to the terminal electrode 441 of the balun transformer 400. The land pattern 452 is a pattern connected to the ground wiring GNDL, and is connected to the terminal electrodes 442, 445, and 446 of the balun transformer 400. Thereby, the terminal electrodes 442 and 445 configure the center tap of the secondary winding. The land patterns 453 and 454 are patterns connected to a pair of balanced transmission lines STL and SBL, and are respectively connected to the terminal electrode 443 and the terminal electrode 444 of the balun transformer 400.

The balun transformer 400 does not have any directionality, and therefore the same wire-connection state can be obtained even when switching the position of a pair of flanges 412 and 413 arranged on both ends of the core unit 411. That is, even when the balun transformer 400 is rotated by 180° at the time of mounting, the correct operation can be performed. Reference numerals of the terminal electrodes connected to the land patterns 451 to 454 at the time of rotating the balun transformer 400 by 180° are as shown within brackets in FIG. 22. Thus, because the balun transformer 400 does not have any directionality, it is not necessary to control the mounting direction, thereby decreasing mounting costs.

Further, in the balun transformer 400, the wires 432 and 433 wound by bifilar winding do not intersect each other at any location (any location where positions of the wires 432 and 433 are switched). Accordingly, it is not necessary to intersect the wires 432 and 433 during the wire-winding operation, thereby enabling production without utilizing any complex winding machine.

Further, in the balun transformer 400, each of the wirings (PL, STL, STB, and GNDL) can be connected to the terminal electrodes 441, 443, 444, and 446 positioned at the corners, and accordingly, it becomes easy to connect the wiring on the printed-circuit board with the balun transformer 400.

A fifth embodiment of the present invention is described next.

Figure 23:
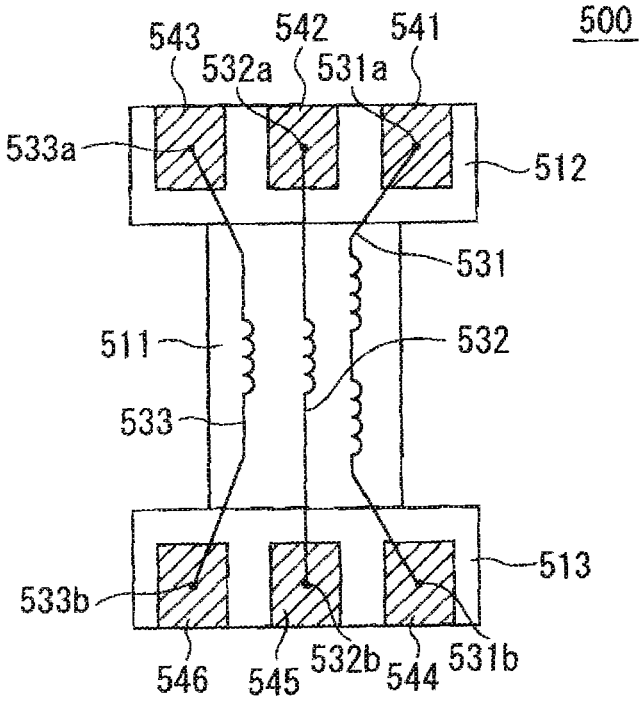
FIG. 23 is a schematic diagram for explaining a connection relationship between the wires and terminal electrodes of a balun transformer 500 according to the fifth embodiment.

FIG. 23 is a schematic diagram for explaining a connection relationship between the wires and terminal electrodes of a balun transformer 500 according to the fifth embodiment. The appearance and the cross section of the balun transformer 500 according to the fifth embodiment are also substantially identical to those of the balun transformer 100 according to the first embodiment shown in FIG. 1 and FIG. 2.

As shown in FIG. 23, three wires 531 to 533 are connected to the terminal electrodes 541 to 546 according to the fifth embodiment. Among these, the wire 531 configures the primary winding, and the wires 532 and 533 configure the secondary winding. One end 531*a* of the wire 531 is connected to the terminal electrode 541, and the other end 531*b* is connected to the terminal electrode 554. One end 532*a* of the wire 532 is connected to the terminal electrode 542, and the other end 532*b* is connected to the terminal electrode 545. One end 533*a* of the wire 533 is connected to the terminal electrode 543, and the other end 533*b* is connected to the terminal electrode 546. In the fifth embodiment, the wire 531 is wound in eight turns, while the wires 532 and 533 are wound in four turns each. Further, the equivalent circuit of the balun transformer 500 is the same as that shown in FIG. 5.

Figure 24:
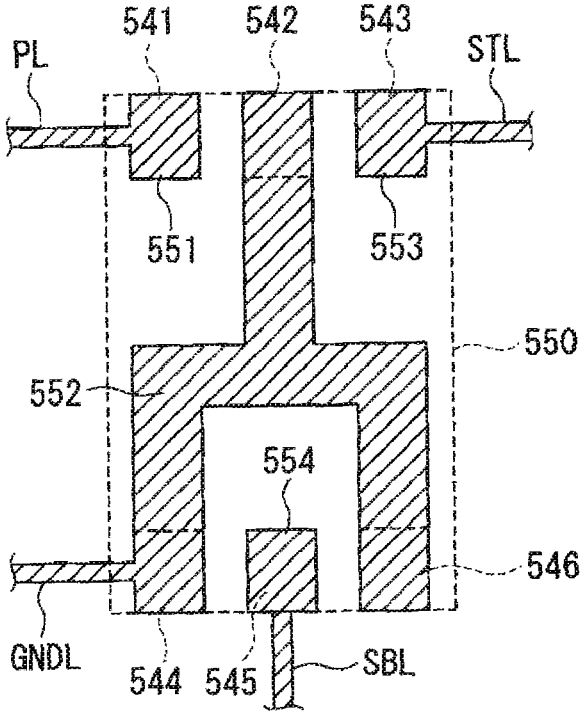
FIG. 24 shows a wiring pattern on the printed-circuit board for mounting the balun transformer 500 according to the fifth embodiment.

FIG. 24 shows a wiring pattern on the printed-circuit board for mounting the balun transformer 500 according to the fifth embodiment.

Amount region 550 on the printed-circuit board shown in FIG. 24 is a region for mounting the balun transformer 500, and is arranged with four land patterns 551 to 554. The land pattern 551 is a pattern connected to the unbalanced transmission line PL, and is connected to the terminal electrode 541 of the balun transformer 500. The land pattern 552 is a pattern connected to the ground wiring GNDL, and is connected to the terminal electrodes 542, 544, and 546 of the balun transformer 500. Thereby, the terminal electrodes 542 and 546 configure the center tap of the secondary winding. The land patterns 553 and 554 are patterns connected to a pair of balanced transmission lines STL and SBL, and are respectively connected to the terminal electrode 543 and the terminal electrode 545 of the balun transformer 500.

Similarly to the balun transformer 400 according to the fourth embodiment, also in the balun transformer 500 according to the fifth embodiment, the wires 532 and 533 wound by bifilar winding do not interest each other at any position. Thus, it is not necessary to intersect the wires 532 and 533 during the wire-winding operation, thereby enabling production without utilizing any complex winding machine.

Further, in the balun transformer 500, both ends of all the wires 531 to 533 are connected to terminal electrodes that are opposite to each other, and accordingly, these three wires can be maintained in a uniform state, with substantially no difference in the lengths and winding conditions.

A sixth embodiment of the present invention is described next.

Figure 25:
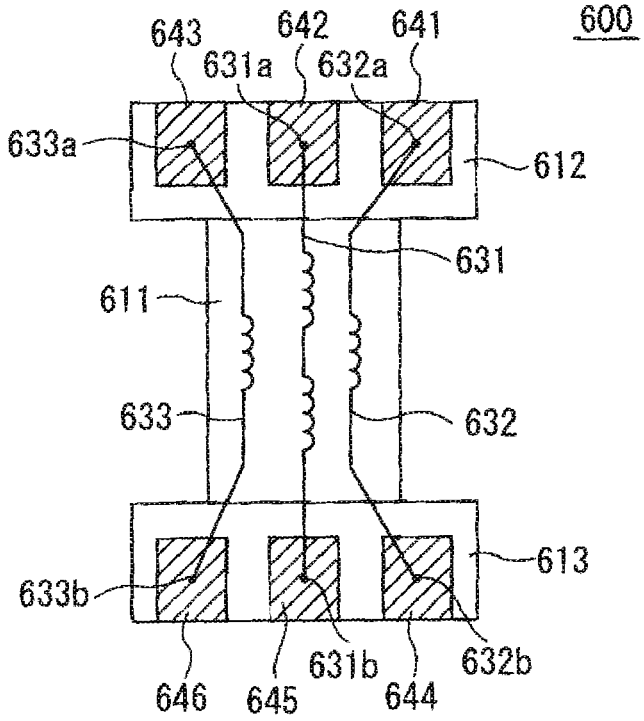
FIG. 25 is a schematic diagram for explaining a connection relationship between wires and terminal electrodes of a balun transformer 600 according to the sixth embodiment.

FIG. 25 is a schematic diagram for explaining a connection relationship between wires and terminal electrodes of a balun transformer 600 according to the sixth embodiment. The appearance and the cross section of the balun transformer 600 according to the sixth embodiment are substantially identical to those of the balun transformer 100 according to the first embodiment shown in FIG. 1 and FIG. 2.

As shown in FIG. 25, three wires 631 to 633 are connected to terminal electrodes 641 to 646 according to the sixth embodiment. Among these wires, the wire 631 configures the primary winding, and the wires 632 and 633 configure the secondary winding. One end 631*a* of the wire 631 is connected to the terminal electrode 642, and the other end 631*b* is connected to the terminal electrode 645. One end 632*a* of the wire 632 is connected to the terminal electrode 641, and the other end 632*b* is connected to the terminal electrode 644. Further, one end 633*a* of the wire 633 is connected to the terminal electrode 643, and the other end 633*b* is connected to the terminal electrode 646. In the sixth embodiment, the wire 631 is wound in eight turns, while the wires 632 and 633 are wound in four turns each. Further, the equivalent circuit of the balun transformer 600 is the same as that shown in FIG. 5.

Figure 26:
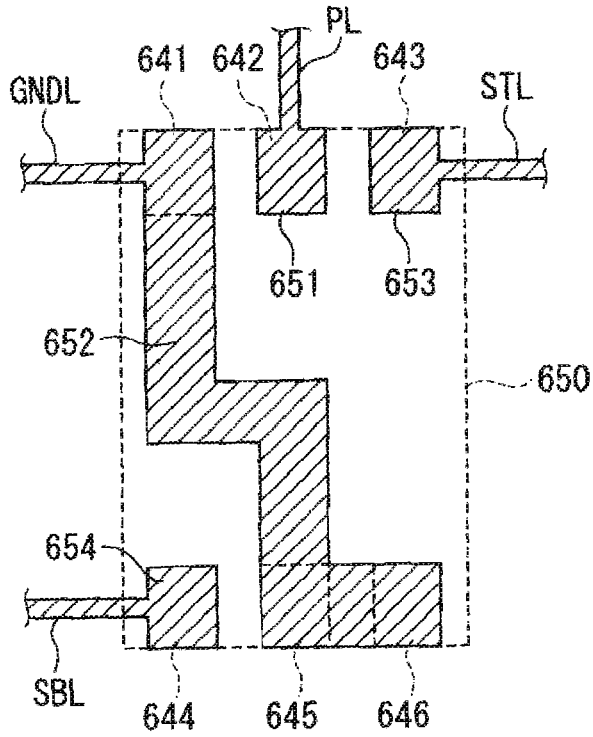
FIG. 26 shows a wiring pattern on the printed-circuit board for mounting the balun transformer 600 according to the sixth embodiment.

FIG. 26 shows a wiring pattern on the printed-circuit board for mounting the balun transformer 600 according to the sixth embodiment.

A mount region 650 on the printed-circuit board shown in FIG. 26 is a region for mounting the balun transformer 600, and is arranged with four land patterns 651 to 654. The land pattern 651 is a pattern connected to the unbalanced transmission line PL, and is connected to the terminal electrode 642 of the balun transformer 600. The land pattern 652 is a pattern connected to the ground wiring GNDL, and is connected to the terminal electrodes 641, 645, and 646 of the balun transformer 600. Thereby, the terminal electrodes 645 and 646 configure the center tap of the secondary winding. The land patterns 653 and 654 are patterns connected to a pair of balanced transmission lines STL and SBL, and are respectively connected to the terminal electrode 643 and the terminal electrode 644 of the balun transformer 600.

The balun transformer 600 does not have any directionality, and accordingly, the same wire-connection state can be obtained even when switching the position of a pair of flanges 612 and 613 arranged on both ends of the core unit 611. That is, even when the balun transformer 600 is rotated by 180° at the time of mounting, the correct operation can be performed. Thus, due to the fact that the balun transformer 600 does not have any directionality, it is not necessary to control the mounting direction, thereby decreasing mounting costs.

Further, in the balun transformer 600, the wires 632 and 633 wound by bifilar winding do not intersect each other at any location (any location where positions of the wires 632 and 633 are switched). Thus, the wires 632 and 633 do not need to be intersected during the wire-winding operation, thereby enabling production without utilizing any complex winding machine.

A seventh embodiment of the present invention is described next.

Figure 27:
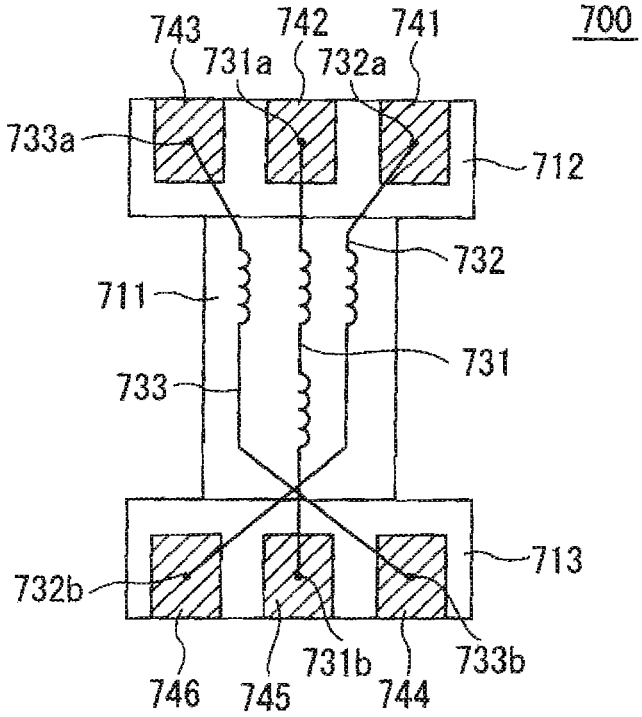
FIG. 27 is a schematic diagram for explaining a connection relationship between the wires and terminal electrodes of a balun transformer 700 according to the seventh embodiment.

FIG. 27 is a schematic diagram for explaining a connection relationship between the wires and terminal electrodes of a balun transformer 700 according to the seventh embodiment. The appearance and the cross section of the balun transformer 700 according to the seventh embodiment are substantially identical to those of the balun transformer 100 according to the first embodiment shown in FIG. 1 and FIG. 2.

As shown in FIG. 27, three wires 731 to 733 are connected to terminal electrodes 741 to 746 according to the seventh embodiment. Among these wires, the wire 731 configures the primary winding, and the wires 732 and 733 configure the secondary winding. One end 731*a* of the wire 731 is connected to the terminal electrode 742, and the other end 731*b* is connected to the terminal electrode 745. One end 732*a* of the wire 732 is connected to the terminal electrode 741, and the other end 732*b* is connected to the terminal electrode 746. One end 733*a* of the wire 733 is connected to the terminal electrode 743, and the other end 733*b* is connected to the terminal electrode 744. In the seventh embodiment, the wire 731 is wound in eight turns, while the wires 732 and 733 are wound in four turns each. Further, the equivalent circuit of the balun transformer 700 is the same as that shown in FIG. 5.

Figure 28:
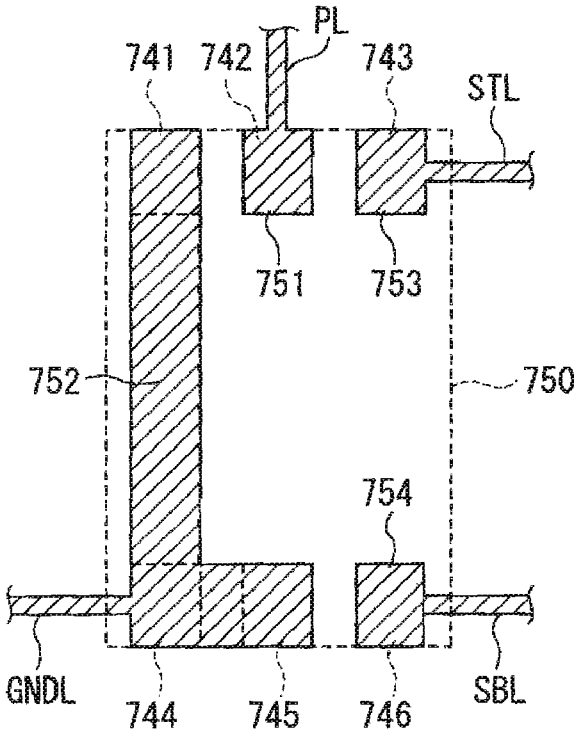
FIG. 28 shows a wiring pattern on the printed-circuit board for mounting the balun transformer 700.

FIG. 28 shows a wiring pattern on the printed-circuit board for mounting the balun transformer 700.

Amount region 750 on the printed-circuit board shown in FIG. 28 is a region for mounting the balun transformer 700, and is arranged with four land patterns 751 to 754. The land pattern 751 is a pattern connected to the unbalanced transmission line PL, and is connected to the terminal electrode 742 of the balun transformer 700. The land pattern 752 is a pattern connected to the ground wiring GNDL, and is connected to the terminal electrodes 741, 744, and 745 of the balun transformer 700. Thereby, the terminal electrodes 741 and 744 configure the center tap of the secondary winding. The land patterns 753 and 754 are patterns connected to a pair of balanced transmission lines STL and SBL, and are respectively connected to the terminal electrode 743 and the terminal electrode 746 of the balun transformer 700.

The balun transformer 700 does not have any directionality, and therefore the same wire-connection state can be obtained even when switching the position of a pair of flanges 712 and 713 arranged on both ends of the core unit 711. That is, even when the balun transformer 700 is rotated by 180° at the time of mounting, the correct operation can be performed. Thus, because the balun transformer 700 does not have any directionality, it is not necessary to control the mounting direction, thereby decreasing mounting costs.

Further, the pair of balanced transmission lines STL and SBL can be formed in parallel and linearly, and accordingly, it becomes unnecessary to detour the balanced transmission lines STL and SBL on the printed-circuit board, thereby making it possible to secure the symmetry between the pair of balanced transmission lines STL and SBL.

While a preferred embodiment of the present invention has been described hereinbefore, the present invention is not limited to the aforementioned embodiment and various modifications can be made without departing from the spirit of the present invention. It goes without saying that such modifications are included in the scope of the present invention.

Figure 29:
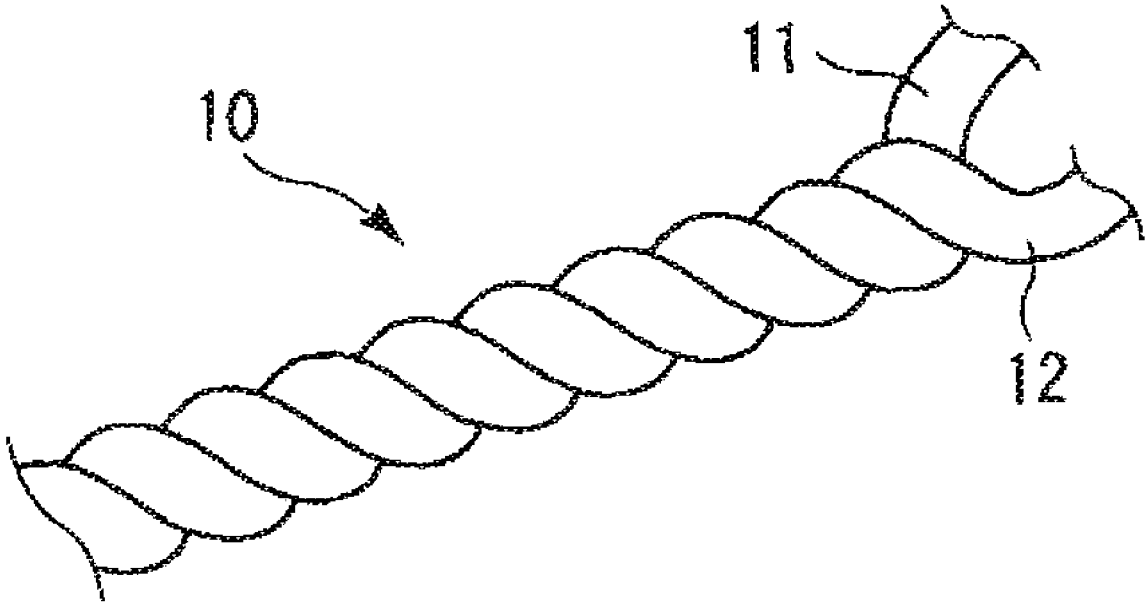
FIG. 29 shows a twisted wire 10 which is utilizable as the secondary winding.

For example, in each of the first to seventh embodiments, the bifilar winding is performed for the two wires configuring the secondary winding. However, the winding method is not limited to the bifilar winding as long as the two wires are wound along each other. Accordingly, as shown in FIG. 29, the two wires 11 and 12 are twisted to use a twisted wire 10, and such a twisted wire 10 can be wound around the core unit to use it as the secondary winding.

EXAMPLES

While Examples of the present invention are explained below, the present invention is not limited thereto.

First, a balun transformer according to an Example having the configuration shown in FIG. 1 to FIG. 3, and a balun transformer according to a comparative example having a configuration shown in FIG. 6 were prepared. As explained above, the wires 132 and 133 configuring the secondary winding in the balun transformer according to the Example are wound by bifilar winding, while the wires 132 and 133 configuring the secondary winding in the balun transformer of the comparative example are wound by sector winding. Only the winding method of the secondary winding differs between the two examples, and all of the remaining features are the same. Note that a NiZn ferrite was used as the material for the drum-shaped core and the plate-shaped core in both the cases.

Figure 30:
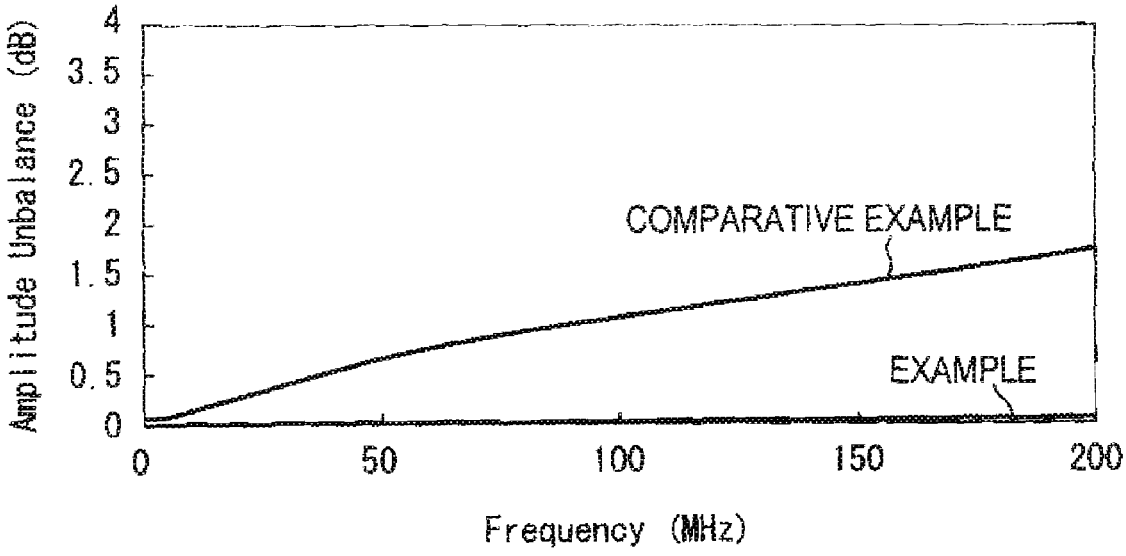
FIG. 30 shows measurement results for the amplitude unbalance.

Next, the frequency characteristics of the amplitude unbalance and phase unbalance were measured for the balun transformers according to the Example and the comparative example. FIG. 30 shows measurement results for the amplitude unbalance, and FIG. 31 shows measurement results for the phase unbalance.

As shown in FIG. 30, the amplitude unbalance of the balun transformer according to the Example is almost 0 dB in the measured frequency range (0 to 200 MHz). It was confirmed that the amplitude balance of the balanced signals was equal. In contrast thereto, in the balun transformer of the comparative example, as the frequency is higher, the amplitude balance collapses, and thus it was confirmed that the amplitude balance of balanced signals was further lowered in higher frequency areas.

Figure 31:
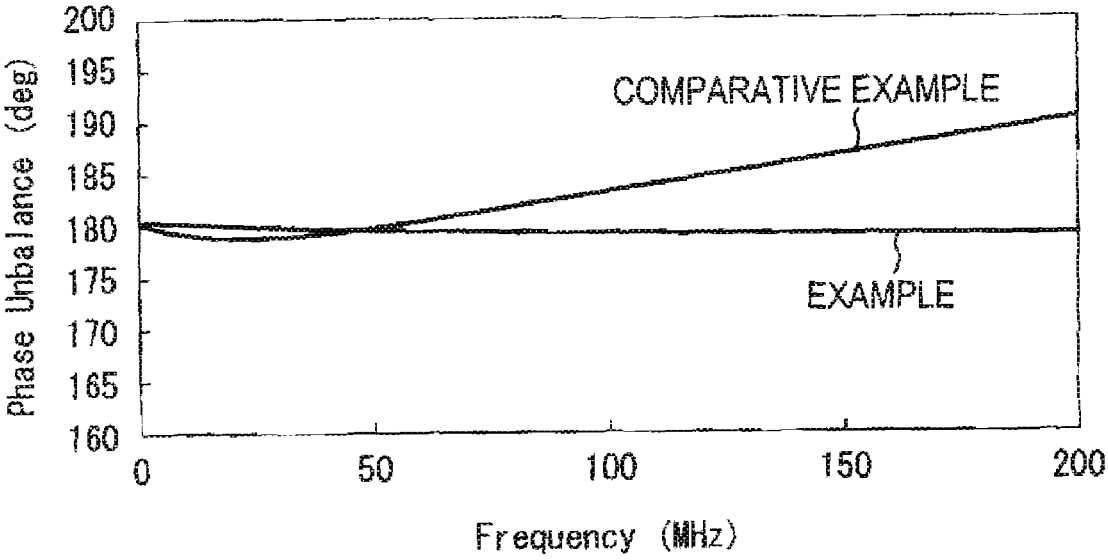
FIG. 31 shows measurement results for the phase unbalance.

As shown in FIG. 31, the phase unbalance of the balun transformer according to the Example is almost 180° in the measured frequency range, and thus it was confirmed that the phase of the balanced signals was correctly reversed. In contrast thereto, in the balun transformer of the comparative example, as the frequency is higher, the phase unbalance shifts away from the 180-degree level, and it was confirmed that the phase of balanced signals was further deviated in higher frequency areas.

What is claimed is:

1. A balun transformer comprising:

a drum-shaped core having a core unit and first and second flanges arranged on both sides of the core unit;

first to third terminal electrodes arranged on the first flange;

fourth to sixth terminal electrodes arranged on the second flange;

a first wire wound in a first number of turns around the core unit, the first wire having one end connected to the first terminal electrode and other end connected to the fourth terminal electrode;

a second wire wound in a second number of turns around the core unit, the second wire having one end connected to the second terminal electrode and other end connected to the fifth terminal electrode;

a third wire wound in a third number of turns around the core unit, the third wire having one end connected to the third terminal electrode and other end connected to the sixth terminal electrode, wherein the first number is different from the second and third numbers, and the second and third numbers are same as each other.

2. The balun transformer as claimed in claim 1, wherein the first number is larger than the second and third numbers.

3. The balun transformer as claimed in claim 1, wherein the first to third terminal electrodes are arranged in this order as viewed from a predetermined direction on the first flange, and the fourth to sixth terminal electrodes are arranged in different from this order as viewed from the predetermined direction on the second flange.

4. The balun transformer as claimed in claim 3, wherein the fourth, sixth, and fifth terminal electrodes are arranged in this order as viewed from the predetermined direction on the second flange.

5. The balun transformer as claimed in claim 3, wherein the fifth, sixth, and fourth terminal electrodes are arranged in this order as viewed from the predetermined direction on the second flange.

6. The balun transformer as claimed in claim 3, wherein the sixth, fifth, and fourth terminal electrodes are arranged in this order as viewed from the predetermined direction on the second flange.

7. The balun transformer as claimed in claim 1, wherein the first to third terminal electrodes are arranged in this order as viewed from a predetermined direction on the first flange, and the fourth to sixth terminal electrodes are arranged in this order as viewed from the predetermined direction on the second flange.

8. The balun transformer as claimed in claim 1, wherein the second, first, and third terminal electrodes are arranged in this order as viewed from a predetermined direction on the first flange, and the fifth, fourth, and sixth terminal electrodes are arranged in this order as viewed from the predetermined direction on the second flange.

9. The balun transformer as claimed in claim 1, wherein the second wire and the third wire are wound around the core unit so as to extend along each other.

10. A balun transformer comprising:

a drum-shaped core having a core unit and first and second flanges arranged on both sides of the core unit;

a first electrode group arranged on the first flange constituted of a plurality of terminal electrodes arranged in line including at least a first terminal electrode located at a near end of the first electrode group viewed from a predetermined direction and a second terminal electrode located at a far end of the first electrode group viewed from the predetermined direction;

a second electrode group arranged on the second flange constituted of a plurality of terminal electrodes arranged in line including at least a third terminal electrode located at a near end of the second electrode group viewed from the predetermined direction and a fourth terminal electrode located at a far end of the second electrode group viewed from the predetermined direction;

a primary winding wound around the core unit, the primary winding having first and second ends; and a secondary winding wound around the core unit, the secondary winding having third and fourth ends and a center tap, the secondary winding including a first wire extending from the third end to the center tap and a second wire extending from the fourth end to the center tap, wherein the first end of the primary winding is connected to the first terminal electrode, the second end of the primary winding is connected to one of the second and third terminal electrodes, the third end of the secondary winding is connected to other of the second and third terminal electrodes, the fourth end of the secondary winding is connected to the fourth terminal electrode, and the center tap of the secondary winding is connected to one or more of the terminal electrodes.

11. The balun transformer as claimed in claim 10, wherein the first electrode group further includes a fifth terminal electrode located between the first and second terminal electrode, the second electrode group further includes a sixth terminal electrode located between the third and fourth terminal electrode, the second end of the primary winding is connected to the third terminal electrode, the third end of the secondary winding is connected to the second terminal electrode, the center tap belonging to the first wire is connected to the sixth terminal electrode, and the center tap belonging to the second wire is connected to the fifth terminal electrode.

12. The balun transformer as claimed in claim 11, wherein the primary winding includes a third wire extending from the first end to a relay point and a fourth wire extending from the second end to the relay point, the first electrode group further includes a seventh terminal electrode located between the first and fifth terminal electrode, the second electrode group further includes an eighth terminal electrode located between the third and sixth terminal electrode, the relay point belonging to the third wire is connected to the eighth terminal electrode, and the relay point belonging to the fourth wire is connected to the seventh terminal electrode.

13. The balun transformer as claimed in claim 10, wherein the second end of the primary winding is connected to the second terminal electrodes, the third end of the secondary winding is connected the third terminal electrode, and the center tap of the secondary winding is connected to the second terminal electrode.

14. The balun transformer as claimed in claim 13, wherein the primary winding is wound on an outer circumferential side of the core unit, and the secondary winding is wound on an inner circumferential side of the core unit.

15. The balun transformer as claimed in claim 10, wherein the first wire and the second wire are wound around the core unit so as to extend along each other.

16. The balun transformer as claimed in claim 12, wherein the third wire and the fourth wire are wound around the core unit so as to extend along each other.

17. A device having a circuit board and a balun transformer mounted on the circuit board, wherein the circuit board includes at least first to fourth land patterns, the balun transformer includes: a drum-shaped core having a core unit and a pair of flanges arranged on both sides of the core unit; a plurality of terminal electrodes arranged on the flanges; a primary winding wound around the core unit, both ends of the primary winding being connected to the terminal electrodes; and a secondary winding wound around the core unit, both ends and a center tap of the secondary winding being connected to the terminal electrodes, the terminal electrode connected to one end of the primary winding is connected to the first land pattern, the terminal electrode connected to other end of the primary winding is connected to the second land pattern, the terminal electrode connected to one end of the secondary winding is connected to the third land pattern, the terminal electrode connected to other end of the secondary winding is connected to the fourth land pattern, and the terminal electrode connected to the center tap of the secondary winding is connected to the second land pattern.

18. The device as claimed in claim 17, wherein the secondary winding includes a first wire extending from the one end to the center tap, and a second wire extending from the other end to the center tap, and the terminal electrodes connected to the center tap of the secondary winding belonging to the first and second wires, respectively, are connected via the fourth land pattern.

19. The device as claimed in claim 17, wherein the secondary winding includes a first wire extending from the one end to the center tap, and a second wire extending from the other end to the center tap, the center tap of the secondary winding belonging to the first wire and the center tap of the secondary winding belonging to the second wire are electrically and physically connected to a same terminal electrode.

20. The device as claimed in claim 18, wherein the first wire and the second wire are wound around the core unit so as to extend along each other.

* * * * *